US008240839B2

(12) United States Patent
Yamanobe

(10) Patent No.: US 8,240,839 B2
(45) Date of Patent: Aug. 14, 2012

(54) IMAGE FORMING METHOD AND APPARATUS

(75) Inventor: Jun Yamanobe, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 481 days.

(21) Appl. No.: 12/489,946

(22) Filed: Jun. 23, 2009

(65) Prior Publication Data

US 2009/0315926 A1 Dec. 24, 2009

(30) Foreign Application Priority Data

Jun. 24, 2008 (JP) ..... 2008-164931

(51) Int. Cl.
*B41J 29/38* (2006.01)

(52) U.S. Cl. ..... 347/102; 347/101; 347/5

(58) Field of Classification Search ..... 347/5, 9, 347/101–102

See application file for complete search history.

(56) References Cited

U.S. PATENT DOCUMENTS

| | | | | |
|---|---|---|---|---|
| 7,044,593 | B2 * | 5/2006 | Onishi | 347/101 |
| 7,517,075 | B2 * | 4/2009 | Smith et al. | 347/102 |
| 2004/0141041 | A1 * | 7/2004 | Tsutsumi et al. | 347/102 |
| 2006/0238592 | A1 * | 10/2006 | Kadomatsu et al. | 347/102 |

FOREIGN PATENT DOCUMENTS

| | | |
|---|---|---|
| JP | 2003-131506 A | 5/2003 |

* cited by examiner

*Primary Examiner* — Lam S Nguyen

(74) *Attorney, Agent, or Firm* — Birch, Stewart, Kolasch & Birch, LLP

(57) ABSTRACT

The image forming method forms an image on a recording medium by using aqueous ink and treatment liquid. The ink contains coloring material, and the treatment liquid contains a component which reacts with the coloring material. The image forming method includes: a treatment liquid deposition step of depositing the treatment liquid onto the recording medium; an ink deposition step of ejecting and depositing droplets of the aqueous ink in accordance with image information, onto the recording medium on which the treatment liquid has been deposited in the treatment liquid deposition step; an ink drying step of drying an ink layer which has been formed on the recording medium by reaction between the treatment liquid deposited in the treatment liquid deposition step and the aqueous ink deposited in the ink deposition step, such that an amount of water originating from the aqueous ink and still remaining on the recording medium after the ink drying step is not more than 4.0 g/m$^2$; and a fixing step of fixing the ink layer which has been dried in the ink drying step on the recording medium by applying heat and pressure to the ink layer.

9 Claims, 14 Drawing Sheets

FIG.9

TEST A <INK 1>

| TEST NO. | PAPER | DEPOSITION OF TREATMENT LIQUID | DRYING OF TREATMENT LIQUID | DRYING OF INK | AMOUNT OF WATER REMAINING AFTER DRYING OF INK (g/m$^2$) | OFFSET 50℃/75℃ | FIXING | CURL | BLEEDING | FLOATING OF DOT |
|---|---|---|---|---|---|---|---|---|---|---|
| 1-1 | TOKUBISHI ART | NO | - | NO | 8.8 | POOR/POOR | FAIR | POOR | POOR | GOOD |
| 1-2 | TOKUBISHI ART | YES | NO | NO | 8.8 | POOR/POOR | PASSING | POOR | GOOD | POOR |
| 1-3 | TOKUBISHI ART | YES | YES | NO | 8.8 | POOR/POOR | FAIR | POOR | GOOD | GOOD |
| 1-4 | TOKUBISHI ART | NO | - | Lv.1 | 5.5 | POOR/POOR | FAIR | POOR | POOR | GOOD |
| 1-5 | TOKUBISHI ART | YES | YES | Lv.1 | 5.2 | FAIR/FAIR | GOOD | GOOD | GOOD | GOOD |
| 1-6 | TOKUBISHI ART | NO | - | Lv.2 | 4.0 | POOR/POOR | FAIR | FAIR | POOR | GOOD |
| 1-7 | TOKUBISHI ART | YES | YES | Lv.2 | 4.0 | GOOD/GOOD | GOOD | GOOD | GOOD | GOOD |
| 1-8 | TOKUBISHI ART | NO | - | Lv.3 | 2.0 | POOR/POOR | GOOD | GOOD | POOR | GOOD |
| 1-9 | TOKUBISHI ART | YES | YES | Lv.3 | 2.0 | GOOD/GOOD | GOOD | GOOD | GOOD | GOOD |
| 1-10 | TOKUBISHI ART | YES | YES | Lv.4 | 0.9 | GOOD/GOOD | GOOD | GOOD | GOOD | GOOD |
| 1-11 | TOKUBISHI ART | YES | YES | Lv.5 | 0.3 | GOOD/GOOD | GOOD | FAIR | GOOD | GOOD |
| 1-12 | OK TOP COAT | NO | - | NO | 8.8 | POOR/POOR | FAIR | POOR | POOR | GOOD |
| 1-13 | OK TOP COAT | YES | NO | NO | 8.8 | POOR/POOR | PASSING | POOR | GOOD | POOR |
| 1-14 | OK TOP COAT | YES | YES | NO | 8.8 | POOR/POOR | FAIR | POOR | GOOD | GOOD |
| 1-15 | OK TOP COAT | NO | - | Lv.1 | 5.5 | POOR/POOR | FAIR | POOR | POOR | GOOD |
| 1-16 | OK TOP COAT | YES | YES | Lv.1 | 5.3 | FAIR/FAIR | GOOD | GOOD | GOOD | GOOD |
| 1-17 | OK TOP COAT | NO | - | Lv.2 | 4.0 | POOR/POOR | GOOD | GOOD | GOOD | GOOD |
| 1-18 | OK TOP COAT | YES | YES | Lv.2 | 4.0 | GOOD/GOOD | GOOD | GOOD | GOOD | GOOD |
| 1-19 | OK TOP COAT | NO | - | Lv.3 | 2.1 | POOR/POOR | GOOD | GOOD | POOR | GOOD |
| 1-20 | OK TOP COAT | YES | YES | Lv.3 | 2.1 | GOOD/GOOD | GOOD | GOOD | GOOD | GOOD |
| 1-21 | OK TOP COAT | YES | YES | Lv.4 | 1.0 | GOOD/GOOD | GOOD | GOOD | GOOD | GOOD |
| 1-22 | OK TOP COAT | YES | YES | Lv.5 | 0.3 | GOOD/GOOD | GOOD | FAIR | GOOD | GOOD |
| 1-23 | NEW AGE | NO | - | NO | 8.8 | POOR/POOR | FAIR | POOR | POOR | GOOD |
| 1-24 | NEW AGE | YES | NO | NO | 8.8 | POOR/POOR | PASSING | POOR | GOOD | POOR |
| 1-25 | NEW AGE | YES | YES | NO | 8.8 | POOR/POOR | FAIR | POOR | GOOD | GOOD |
| 1-26 | NEW AGE | NO | - | Lv.1 | 7.3 | POOR/POOR | FAIR | POOR | POOR | GOOD |
| 1-27 | NEW AGE | YES | YES | Lv.1 | 6.8 | POOR/POOR | GOOD | POOR | GOOD | GOOD |
| 1-28 | NEW AGE | NO | - | Lv.2 | 5.1 | FAIR/FAIR | FAIR | POOR | POOR | GOOD |
| 1-29 | NEW AGE | YES | YES | Lv.2 | 4.7 | FAIR/FAIR | GOOD | GOOD | GOOD | GOOD |
| 1-30 | NEW AGE | NO | - | Lv.3 | 4.0 | FAIR/FAIR | FAIR | POOR | POOR | GOOD |
| 1-31 | NEW AGE | YES | YES | Lv.3 | 4.0 | GOOD/GOOD | GOOD | GOOD | GOOD | GOOD |
| 1-32 | NEW AGE | YES | YES | Lv.4 | 2.0 | GOOD/GOOD | GOOD | GOOD | GOOD | GOOD |
| 1-33 | NEW AGE | YES | YES | Lv.5 | 0.7 | GOOD/GOOD | GOOD | GOOD | GOOD | GOOD |

FIG.10

TEST B <INK 2>

| TEST NO. | PAPER | DEPOSITION OF TREATMENT LIQUID | DRYING OF TREATMENT LIQUID | DRYING OF INK | AMOUNT OF WATER REMAINING AFTER DRYING OF INK ($g/m^2$) | OFFSET 50°C/75°C | FIXING | CURL | BLEEDING | FLOATING OF DOT |
|---|---|---|---|---|---|---|---|---|---|---|
| 2-1 | TOKUBISHI ART | YES | YES | NO | 8.8 | POOR/POOR | FAIR | POOR | GOOD | GOOD |
| 2-2 | TOKUBISHI ART | YES | YES | Lv. 1 | 5.3 | FAIR/FAIR | GOOD | POOR | GOOD | GOOD |
| 2-3 | TOKUBISHI ART | YES | YES | Lv. 2 | 4.0 | GOOD/GOOD | GOOD | FAIR | GOOD | GOOD |
| 2-4 | TOKUBISHI ART | YES | YES | Lv. 3 | 2.2 | GOOD/GOOD | GOOD | FAIR | GOOD | GOOD |
| 2-5 | TOKUBISHI ART | YES | YES | Lv. 4 | 0.9 | GOOD/GOOD | GOOD | FAIR | GOOD | GOOD |
| 2-6 | TOKUBISHI ART | YES | YES | Lv. 5 | 0.2 | GOOD/GOOD | GOOD | FAIR | GOOD | GOOD |
| 2-7 | OK TOP COAT | YES | YES | NO | 8.8 | POOR/POOR | FAIR | POOR | GOOD | GOOD |
| 2-8 | OK TOP COAT | YES | YES | Lv. 1 | 5.2 | FAIR/FAIR | GOOD | POOR | GOOD | GOOD |
| 2-9 | OK TOP COAT | YES | YES | Lv. 2 | 4.0 | GOOD/GOOD | GOOD | FAIR | GOOD | GOOD |
| 2-10 | OK TOP COAT | YES | YES | Lv. 3 | 2.2 | GOOD/GOOD | GOOD | FAIR | GOOD | GOOD |
| 2-11 | OK TOP COAT | YES | YES | Lv. 4 | 1.1 | GOOD/GOOD | GOOD | FAIR | GOOD | GOOD |
| 2-12 | OK TOP COAT | YES | YES | Lv. 5 | 0.3 | GOOD/GOOD | GOOD | FAIR | GOOD | GOOD |
| 2-13 | NEW AGE | YES | YES | NO | 8.8 | POOR/POOR | FAIR | POOR | GOOD | GOOD |
| 2-14 | NEW AGE | YES | YES | Lv. 1 | 7.0 | POOR/POOR | GOOD | POOR | GOOD | GOOD |
| 2-15 | NEW AGE | YES | YES | Lv. 2 | 4.9 | FAIR/FAIR | GOOD | POOR | GOOD | GOOD |
| 2-16 | NEW AGE | YES | YES | Lv. 3 | 4.0 | GOOD/GOOD | GOOD | FAIR | GOOD | GOOD |
| 2-17 | NEW AGE | YES | YES | Lv. 4 | 2.2 | GOOD/GOOD | GOOD | FAIR | GOOD | GOOD |
| 2-18 | NEW AGE | YES | YES | Lv. 5 | 0.8 | GOOD/GOOD | GOOD | FAIR | GOOD | GOOD |

FIG.11

TEST C <INK 1>

| TEST NO. | PAPER | DEPOSITION OF TREATMENT LIQUID | DRYING OF TREATMENT LIQUID | DEPOSITION RATE OF INK DROPLET | DRYING OF INK | AMOUNT OF WATER REMAINING AFTER DRYING OF INK ($g/m^2$) | OFFSET 50℃/75℃ | CURL |
|---|---|---|---|---|---|---|---|---|
| 1-3 | TOKUBISHI ART | YES | YES | 100% | NO | 8.8 | POOR/POOR | POOR |
| 1-5 | TOKUBISHI ART | YES | YES | 100% | Lv.1 | 5.2 | FAIR/FAIR | GOOD |
| 1-7 | TOKUBISHI ART | YES | YES | 100% | Lv.2 | 3.6 | GOOD/GOOD | GOOD |
| 1-9 | TOKUBISHI ART | YES | YES | 100% | Lv.3 | 2.0 | GOOD/GOOD | GOOD |
| 1-10 | TOKUBISHI ART | YES | YES | 100% | Lv.4 | 0.9 | GOOD/GOOD | GOOD |
| 1-11 | TOKUBISHI ART | YES | YES | 100% | Lv.5 | 0.5 | GOOD/GOOD | FAIR |
| 3-1 | TOKUBISHI ART | YES | YES | 75% | NO | 6.6 | POOR/POOR | POOR |
| 3-2 | TOKUBISHI ART | YES | YES | 75% | Lv.1 | 3.2 | GOOD/GOOD | GOOD |
| 3-3 | TOKUBISHI ART | YES | YES | 75% | Lv.2 | 1.9 | GOOD/GOOD | GOOD |
| 3-4 | TOKUBISHI ART | YES | YES | 75% | Lv.3 | 0.7 | GOOD/GOOD | GOOD |
| 3-5 | TOKUBISHI ART | YES | YES | 75% | Lv.4 | 0.2 | GOOD/GOOD | FAIR |
| 3-6 | TOKUBISHI ART | YES | YES | 68% | NO | 5.3 | FAIR/FAIR | GOOD |
| 3-7 | TOKUBISHI ART | YES | YES | 68% | Lv.1 | 2.2 | GOOD/GOOD | GOOD |
| 3-8 | TOKUBISHI ART | YES | YES | 68% | Lv.2 | 0.9 | GOOD/GOOD | GOOD |
| 3-9 | TOKUBISHI ART | YES | YES | 68% | Lv.3 | 0.3 | GOOD/GOOD | GOOD |
| 3-10 | TOKUBISHI ART | YES | YES | 50% | NO | 4.4 | FAIR/FAIR | GOOD |
| 3-11 | TOKUBISHI ART | YES | YES | 50% | Lv.1 | 1.3 | GOOD/GOOD | GOOD |
| 3-12 | TOKUBISHI ART | YES | YES | 50% | Lv.2 | 0.4 | GOOD/GOOD | GOOD |

FIG.12

TEST D <INK 1>

| TEST NO. | PAPER | DEPOSITION OF TREATMENT LIQUID | DRYING OF TREATMENT LIQUID | DEPOSITION RATE OF INK DROPLET | DRYING OF INK | AMOUNT OF WATER REMAINING AFTER DRYING OF INK ($g/m^2$) | OFFSET 50°C/75°C | CURL |
|---|---|---|---|---|---|---|---|---|
| 1-14 | OK TOP COAT | YES | YES | 100% | NO | 8.8 | POOR/POOR | POOR |
| 1-16 | OK TOP COAT | YES | YES | 100% | Lv. 1 | 5.3 | FAIR/FAIR | GOOD |
| 1-18 | OK TOP COAT | YES | YES | 100% | Lv. 2 | 3.9 | GOOD/GOOD | GOOD |
| 1-20 | OK TOP COAT | YES | YES | 100% | Lv. 3 | 2.1 | GOOD/GOOD | GOOD |
| 1-21 | OK TOP COAT | YES | YES | 100% | Lv. 4 | 1.0 | GOOD/GOOD | GOOD |
| 1-22 | OK TOP COAT | YES | YES | 100% | Lv. 5 | 0.5 | GOOD/GOOD | FAIR |
| 3-13 | OK TOP COAT | YES | YES | 75% | NO | 6.6 | POOR/POOR | POOR |
| 3-14 | OK TOP COAT | YES | YES | 75% | Lv. 1 | 3.2 | GOOD/GOOD | GOOD |
| 3-15 | OK TOP COAT | YES | YES | 75% | Lv. 2 | 2.1 | GOOD/GOOD | GOOD |
| 3-16 | OK TOP COAT | YES | YES | 75% | Lv. 3 | 0.6 | GOOD/GOOD | GOOD |
| 3-17 | OK TOP COAT | YES | YES | 75% | Lv. 4 | 0.2 | GOOD/GOOD | FAIR |
| 3-18 | OK TOP COAT | YES | YES | 68% | NO | 5.3 | FAIR/FAIR | GOOD |
| 3-19 | OK TOP COAT | YES | YES | 68% | Lv. 1 | 2.2 | GOOD/GOOD | GOOD |
| 3-20 | OK TOP COAT | YES | YES | 68% | Lv. 2 | 1.0 | GOOD/GOOD | GOOD |
| 3-21 | OK TOP COAT | YES | YES | 68% | Lv. 3 | 0.4 | GOOD/GOOD | GOOD |
| 3-22 | OK TOP COAT | YES | YES | 50% | NO | 4.4 | FAIR/FAIR | GOOD |
| 3-23 | OK TOP COAT | YES | YES | 50% | Lv. 1 | 1.4 | GOOD/GOOD | GOOD |
| 3-24 | OK TOP COAT | YES | YES | 50% | Lv. 2 | 0.2 | GOOD/GOOD | GOOD |

FIG.13

TEST E <INK 1>

| TEST NO. | PAPER | DEPOSITION OF TREATMENT LIQUID | DRYING OF TREATMENT LIQUID | DEPOSITION RATE OF INK DROPLET | DRYING OF INK | AMOUNT OF WATER REMAINING AFTER DRYING OF INK ($g/m^2$) | OFFSET 50°C/75°C | CURL |
|---|---|---|---|---|---|---|---|---|
| 1-25 | NEW AGE | YES | YES | 100% | NO | 8.8 | POOR/POOR | POOR |
| 1-27 | NEW AGE | YES | YES | 100% | Lv. 1 | 6.8 | POOR/POOR | POOR |
| 1-29 | NEW AGE | YES | YES | 100% | Lv. 2 | 4.7 | POOR/POOR | GOOD |
| 1-31 | NEW AGE | YES | YES | 100% | Lv. 3 | 3.8 | GOOD/GOOD | GOOD |
| 1-32 | NEW AGE | YES | YES | 100% | Lv. 4 | 2.0 | GOOD/GOOD | GOOD |
| 1-33 | NEW AGE | YES | YES | 100% | Lv. 5 | 0.5 | GOOD/GOOD | FAIR |
| 3-25 | NEW AGE | YES | YES | 75% | NO | 6.6 | POOR/POOR | POOR |
| 3-26 | NEW AGE | YES | YES | 75% | Lv. 1 | 4.7 | POOR/POOR | GOOD |
| 3-27 | NEW AGE | YES | YES | 75% | Lv. 2 | 2.7 | GOOD/GOOD | GOOD |
| 3-28 | NEW AGE | YES | YES | 75% | Lv. 3 | 1.9 | GOOD/GOOD | GOOD |
| 3-29 | NEW AGE | YES | YES | 75% | Lv. 4 | 0.4 | GOOD/GOOD | FAIR |
| 3-30 | NEW AGE | YES | YES | 68% | NO | 5.3 | FAIR/FAIR | GOOD |
| 3-31 | NEW AGE | YES | YES | 68% | Lv. 1 | 3.5 | GOOD/GOOD | GOOD |
| 3-32 | NEW AGE | YES | YES | 68% | Lv. 2 | 1.5 | GOOD/GOOD | GOOD |
| 3-33 | NEW AGE | YES | YES | 68% | Lv. 3 | 0.4 | GOOD/GOOD | GOOD |
| 3-34 | NEW AGE | YES | YES | 50% | NO | 4.4 | FAIR/FAIR | GOOD |
| 3-35 | NEW AGE | YES | YES | 50% | Lv. 1 | 2.4 | GOOD/GOOD | GOOD |
| 3-36 | NEW AGE | YES | YES | 50% | Lv. 2 | 0.3 | GOOD/GOOD | GOOD |

IMAGE FORMING METHOD AND APPARATUS

BACKGROUND OF THE INVENTION

1. Field of the Invention

The present invention relates to an image forming method and apparatus, and more particularly, to technology in a two-liquid reaction system which forms an image on a recording medium by using an ink and a treatment liquid, for achieving high image quality by preventing the occurrence of offset in a fixing step for fixing the image, and the occurrence of curling of the recording medium, and the like.

2. Description of the Related Art

An inkjet recording system performs recording by ejecting and depositing droplets of ink onto a recording medium from a plurality of nozzles formed in an inkjet head, and such a system is able to record images of high resolution and high quality, with little noise during the recording operation and low running costs. The ink ejection system may be, for example, a piezoelectric system, which uses the displacement of a piezoelectric element, a thermal system, which uses thermal energy generated by a heating element, or the like.

In the inkjet recording system, when ink droplets are consecutively deposited in such a manner that the ink droplets (ink dots) that are mutually adjacent on the recording medium overlap with each other, these ink droplets combine together due to their surface tension and give rise to a problem of bleeding (landing interference) in which the desired dots cannot be formed.

In the case of dots of the same color, the dots shape is disturbed and in the case of dots of different colors, an additional problem of color mixing occurs. In particular, when recording with a single-pass system using a line head, the difference in the landing time between mutually adjacent ink droplets is short and therefore landing interference is liable to occur and it is difficult to form a sharply defined image.

In response to this, technology is known which achieves high image quality by depositing a so-called treatment liquid onto a recording medium prior to the ink liquid, and causing this treatment liquid to react with the ink. When using pigment particles as the coloring material, the treatment liquid has the function of aggregating the pigment particles by neutralizing the Coulomb repulsion of the particles and thereby increasing the viscosity of the ink liquid. Thereby, interference between deposited dots is suppressed and sharply defined images can be recorded without the occurrence of non-uniformities in density.

Furthermore, it has also been proposed that glossiness and wear resistance (fixing properties) be imparted to the printing surface by pressing a heated roller or fixing belt (fixing member) against the recording medium with a prescribed pressure after forming an image on the recording medium. However, when pressing a roller, a problem known as "offset" occurs in that a portion of the coloring material on the recording medium adheres to the fixing member. This problem of "offset" is liable to occur with aqueous inks which use an aqueous solvent. Japanese Patent Application Publication No. 2003-131506 discloses, as a countermeasure to "offset", that a separating layer made of a silicone resin is arranged on a fixing belt, and an adhesiveness improving layer is arranged so as to achieve separation between the separating layer and the recording medium (paper).

However, although it is possible to prevent offset to a certain degree by adjusting the surface material of the fixing member, as in Japanese Patent Application Publication No. 2003-131506, it cannot be regarded as sufficient. In particular, when forming images at high speed, the paper must make contact with the fixing member while there is solvent still remaining on the surface of the paper, and in such cases, offset occurs even if the properties of the surface material of the fixing member are adjusted.

Furthermore, if an aqueous ink is used, there is a problem in that curl is liable to occur in the recording medium, and this issue must be resolved at the same time.

SUMMARY OF THE INVENTION

The present invention has been contrived in view of these circumstances, an object thereof being to provide an image forming method and an image forming apparatus whereby, in a two-liquid reaction method which uses ink and treatment liquid, offset on the fixing member and curling of the recording medium can be prevented, and therefore images of high quality can be formed.

In order to attain the aforementioned object, the present invention is directed to an image forming method of forming an image on a recording medium by using aqueous ink and treatment liquid, the aqueous ink containing coloring material, the treatment liquid containing a component which reacts with the coloring material, the method comprising: a treatment liquid deposition step of depositing the treatment liquid onto the recording medium; an ink deposition step of ejecting and depositing droplets of the aqueous ink in accordance with image information, onto the recording medium on which the treatment liquid has been deposited in the treatment liquid deposition step; an ink drying step of drying an ink layer which has been formed on the recording medium by reaction between the treatment liquid deposited in the treatment liquid deposition step and the aqueous ink deposited in the ink deposition step, such that an amount of water originating from the aqueous ink and still remaining on the recording medium after the ink drying step is not more than 4.0 $g/m^2$; and a fixing step of fixing the ink layer which has been dried in the ink drying step on the recording medium by applying heat and pressure to the ink layer.

Here, the amount of water originating from the aqueous ink and still remaining on the recording medium after the ink drying step is the amount of water that has been contained as solvent in the aqueous ink and is still remaining on the recording medium after the ink drying step. The amount of remaining water originating from the aqueous ink is calculated by subtracting the amount of remaining water that has been held by the recording medium itself and the amount of remaining water that has been contained as solvent in the treatment liquid from the whole amount of water remaining on the recording medium after the ink drying step.

According to this aspect of the present invention, since the amount of remaining water originating from the ink formed on the recording medium by reaction between the aqueous ink and the treatment liquid is not more than 4.0 $g/m^2$, then it is possible effectively to prevent offset when carrying out the fixing step of fixing the ink layer by applying heat and pressure after the drying, in addition to which it is also possible to prevent the occurrence of curl due to a large amount of remaining water. Thus, it is also possible to prevent offset onto the fixing member and curling of the recording medium in the two-liquid reaction method which uses the ink and the treatment liquid, and therefore it is possible to provide an image forming method which enables the formation of high-quality images.

In this aspect of the present invention, it is important for the purpose of preventing offset that the ink layer should be dried such that the amount of water originating from the ink and still remaining on the recording medium after the drying is not more than 4.0 g/m$^2$ in the two-liquid reaction method which forms an image on the recording medium by using the aqueous ink and the treatment liquid, and if an image is formed without using a treatment liquid, it is not possible to prevent offset even if the amount of water originating from the ink and still remaining on the recording medium after the drying is not more than 4.0 g/m$^2$.

The amount of water originating from the ink and remaining after drying of the ink layer may be beforehand determined in a preliminary experiment, or the like, by measuring the volume of water per unit surface area on the recording medium after image formation (using Karl Fischer's method, or the like), and subtracting the volume of water originally contained in the recording medium and the volume of water originating from the treatment liquid.

Preferably, in the ink drying step, when an amount of water in the aqueous ink having been deposited on the recording medium before the ink drying step is not less than 6.0 g/m$^2$, then the amount of water originating from the aqueous ink and still remaining on the recording medium after the ink drying step is not less than 0.5 g/m$^2$.

Here, the amount of water in the aqueous ink having been deposited on the recording medium does not have to be determined by measurement from the recording medium after image formation, but rather can be determined by calculation from the ink droplet ejection volume obtained from the dot data of the image information.

The inventor discovered that the occurrence of curl in the recording medium is not limited to cases where the amount of water originating from the ink and still remaining after the drying is excessively large, but also happens in cases where an ink layer containing a large amount of water formed by the ink deposited on the recording medium is excessively dried in the ink drying step (excessive drying). This aspect of the present invention stipulates countermeasures in this respect.

More specifically, if the value calculated as the amount of water in the ink layer through calculation of the amount of the aqueous ink deposited on the recording medium from the ejection volume of the aqueous ink ejected as droplets in the ink deposition step is not less than 6.0 g/m$^2$, then the amount of remaining water is not less than 0.5 g/m$^2$ after the ink drying step, and therefore it is also possible to prevent the occurrence of curl caused by excessive drying.

Preferably, the image forming method further comprises, before the ink deposition step, a treatment liquid drying step of drying a treatment liquid layer which has been formed on the recording medium with the treatment liquid deposited in the treatment liquid deposition step.

This aspect of the present invention provides a countermeasure against the floating of dots which is liable to occur in the two-liquid reaction method that is the essential composition for preventing offset in the present invention. Since the treatment liquid drying step of drying the treatment liquid layer is provided between the treatment liquid deposition step and the ink deposition step, then there is no floating movement of the dots. Thus, it is possible to form images of high quality. Furthermore, it is possible to reduce the amount of water that permeates into the recording medium, and therefore the effect in preventing curl of the recording medium can be improved.

Preferably, in the treatment liquid drying step, the treatment liquid layer is dried such that a thickness of the treatment liquid layer after the treatment liquid drying step is not more than 1 μm.

According to this aspect of the present invention, since the drying is carried out in the treatment liquid drying step until the treatment liquid layer becomes an extremely thin layer having the thickness of 1 μm or less, it is possible to prevent the floating of dots yet more reliably.

Preferably, a solvent having a solubility parameter of not more than 27.5 is used as a high-boiling-point water-soluble solvent of the aqueous ink.

According to this aspect of the present invention, since the solvent having the solubility parameter (SP) value of 27.5 or less is used as the high-boiling-point water-soluble solvent of the aqueous ink, it is possible to prevent the occurrence of curl in the recording medium yet more effectively.

Preferably, the ink drying step includes: a division step of virtually dividing an image region of the recording medium into a plurality of portions arranged in a lattice; a calculation step of calculating a deposition volume of the aqueous ink to be deposited onto each of the portions in accordance with dot data derived from the image information for depositing the droplets of the aqueous ink; and a drying control step of controlling a degree of drying of each of the portions in accordance with the deposition volume calculated in the calculation step.

According to this aspect of the present invention, the amount of water originating from the ink and still remaining on the recording medium after the drying is precisely controlled in respect of each of the portions formed by virtually dividing the image region in a lattice, and therefore it is possible to achieve a uniform value of 4.0 g/m$^2$ or lower for the amount of remaining water originating from the ink, in the whole of the recording medium. Furthermore, since the amount of water in the ink before the drying is determined for each of the portions, on the basis of the dot data for the ink droplet ejection according to the image information, and since the degree of drying is controlled on the basis of the results thus determined, it is possible to control the amount of remaining water originating from the ink, irrespective of the image that is printed.

In order to attain the aforementioned object, the present invention is also directed to an image forming apparatus which forms an image on a recording medium by using aqueous ink and treatment liquid, the aqueous ink containing coloring material, the treatment liquid containing a component which reacts with the coloring material, the apparatus comprising: a treatment liquid deposition unit which deposits the treatment liquid onto the recording medium; a treatment liquid drying unit which dries the deposited treatment liquid; an ink deposition unit which ejects and deposits droplets of the aqueous ink in accordance with image information, onto the recording medium on which the treatment liquid has been deposited and dried; an ink drying unit which dries an ink layer on the recording medium, the ink layer having been formed by reaction between the deposited treatment liquid and the deposited aqueous ink; a fixing unit which fixes the dried ink layer on the recording medium by applying heat and pressure to the dried ink layer; and a drying control device which controls the ink drying unit so as to control a degree of drying of the ink layer in accordance with dot data derived from the image information.

According to this aspect of the present invention, it is possible to prevent offset to the fixing member and curl of the recording medium, in the two-liquid reaction method which uses the ink and the treatment liquid, and therefore images of high quality can be formed.

Preferably, the ink drying unit includes an air nozzle which performs blowing of a heated air onto the recording medium; and the drying control device controls the degree of drying by controlling at least one of a blowing volume and a blowing duration of the blowing of the heated air from the air nozzle onto the recording medium.

This aspect of the present invention provides a desirable composition of the ink drying unit and the drying control device.

Preferably, the drying control device controls the ink drying unit so as to control the degree of drying in such a manner that an amount of water originating from the aqueous ink and still remaining on the recording medium after the drying becomes not more than 4.0 g/m$^2$.

According to this aspect of the present invention, since the amount of water originating from the aqueous ink and still remaining on the recording medium after the drying is controlled so as to be 4.0 g/m$^2$ or less, then it is possible to prevent offset and it is also possible to prevent curl caused by an excessive amount of water remaining on the recording medium.

Preferably, when an amount of water in the aqueous ink deposited on the recording medium before the drying is not less than 6.0 g/m$^2$, then the drying control device controls the ink drying unit so as to control the degree of drying in such a manner that the amount of water originating from the aqueous ink and still remaining on the recording medium after the drying does not become less than 0.5 g/m$^2$.

According to this aspect of the present invention, if the amount of water in the deposited ink is a large amount equal to or greater than 6.0 g/m$^2$, then the degree of drying is controlled in such a manner that the amount of remaining water does not become less than 0.5 g/m$^2$, and therefore it is also possible to prevent the occurrence of curl caused by the excessive drying.

In order to attain the aforementioned object, the present invention is also directed to an image forming apparatus which forms an image on a recording medium by using aqueous ink and treatment liquid, the aqueous ink containing coloring material, the treatment liquid containing a component which reacts with the coloring material, the apparatus comprising: a treatment liquid deposition unit which deposits the treatment liquid onto the recording medium; a treatment liquid drying unit which dries the deposited treatment liquid; an ink deposition unit which ejects and deposits droplets of the aqueous ink in accordance with image information, onto the recording medium on which the treatment liquid has been deposited and dried; an ink drying unit which dries an ink layer on the recording medium, the ink layer having been formed by reaction between the deposited treatment liquid and the deposited aqueous ink; a fixing unit which fixes the dried ink layer on the recording medium by applying heat and pressure to the dried ink layer; a system control device which virtually divides an image region of the recording medium into a plurality of portions arranged in a lattice, and determines a deposition volume of the aqueous ink to be deposited onto each of the portions in accordance with dot data derived from the image information; and a drying control device which controls the ink drying unit so as to control a degree of drying of each of the portions in accordance with the deposition volume determined by the system control device.

According to this aspect of the present invention, it is possible to carry out precise drying for each of the portions, and therefore it is possible further to prevent offset to the fixing member and curl of the recording medium, in the two-liquid reaction method which uses the ink and the treatment liquid.

Preferably, the ink drying unit includes a plurality of air nozzles which are disposed equidistantly in a direction perpendicular to the recording medium and blow a heated air onto a surface of the recording medium; and the drying control device controls the degree of drying of each of the portions by controlling at least one of a blowing volume and a blowing duration of the blowing of the heated air from corresponding one of the air nozzles onto each of the portions in accordance with the deposition volume determined by the system control device.

This aspect of the present invention provides a desirable composition of the ink drying unit and the drying control device.

Preferably, the drying control device controls the ink drying unit so as to control the degree of drying of each of the portions in such a manner that an amount of water originating from the aqueous ink and still remaining on each of the portions after the drying becomes not more than 4.0 g/m$^2$.

According to this aspect of the present invention, since the amount of water originating from the aqueous ink and still remaining on each of the portions after the drying is controlled so as to be 4.0 g/m$^2$ or less, then it is possible to prevent offset and it is also possible to prevent curl caused by an excessive amount of water remaining on the recording medium, more effectively.

Preferably, when an amount of water in the aqueous ink deposited on each of the portions before the drying is not less than 6.0 g/m$^2$, then the drying control device controls the ink drying unit so as to control the degree of drying of each of the portions in such a manner that the amount of water originating from the aqueous ink and still remaining on each of the portions after the drying does not become less than 0.5 g/m$^2$.

According to this aspect of the present invention, if the amount of water in the aqueous ink deposited on each of the portions is a large amount equal to or greater than 6.0 g/m$^2$, then the degree of drying is controlled in such a manner that the amount of remaining water does not become less than 0.5 g/m$^2$, and therefore it is also possible to prevent the occurrence of curl caused by the excessive drying.

According to the image forming method and apparatus in the present invention, it is also possible to prevent offset onto the fixing member and curling of the recording medium in the two-liquid reaction method which uses ink and treatment liquid, and therefore it is possible to form images of high quality.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein:

FIG. 9 is a table showing Test A in an example;

FIG. 10 is a table showing Test B in the example;

FIG. 11 is a table showing Test C in the example;

FIG. 12 is a table showing Test D in the example; and

FIG. 13 is a table showing Test E in the example.

DETAILED DESCRIPTION OF THE PREFERRED EMBODIMENTS

Figure 1:
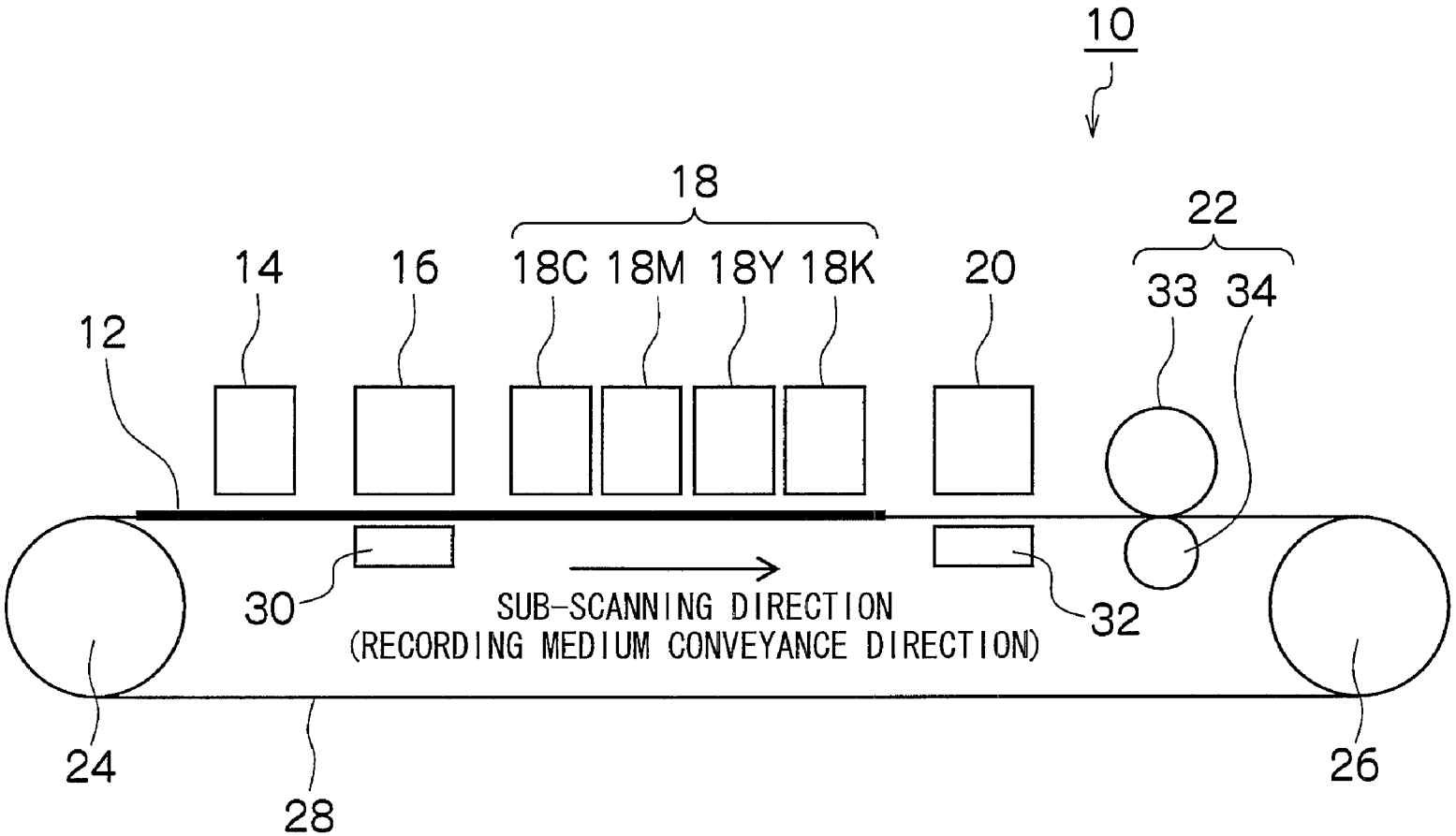
FIG. 1 is a schematic drawing of an image forming apparatus used to describe the principles of an image forming method according to an embodiment of the present invention.

Firstly, the ink and the treatment liquid used in an embodiment of the present invention will be described.

Ink

The ink used in the present embodiment is aqueous pigment ink that contains the following materials insoluble to the solvent (water): pigment particles as the coloring material, and polymer particles.

It is desirable that the concentration of the solvent-insoluble materials in the ink is not less than 1 wt % and not more than 20 wt %, taking account of the fact that the viscosity of the ink suitable for ejection from ink ejection heads is not higher than 20 mPa·s. It is more desirable that the concentration of the pigment in the ink is not less than 4 wt %, in order to obtain good optical density in the image.

The coloring material in the ink may be pigment or a combination of pigment and dye. From the viewpoint of the aggregating characteristics when the ink comes into contact with the treatment liquid, a dispersed pigment in the ink is desirable for more effective aggregation. Desirable pigments include: a pigment dispersed by a dispersant, a self-dispersing pigment, a pigment in which the pigment particle is coated with a resin (hereinafter referred to as "microcapsule pigment"), and a polymer grafted pigment. Moreover, from the viewpoint of the aggregating characteristics of the coloring material, it is more desirable that the coloring material is modified with a carboxyl group having a low degree of dissociation.

There are no particular restrictions on the resin used for a microcapsule pigment, but desirably, it should be a compound of high molecular weight which has a self-dispersing capability or solubility in water, and contains an anionic group (acidic). Generally, it is desirable that the resin should have a number average molecular weight in the approximate range of 1,000 to 100,000, and especially desirably, in the approximate range of 3,000 to 50,000. Moreover, desirably, this resin can dissolved in an organic solvent to form a solution. By limiting the number average molecular weight of the resin to this range, it is possible to make the resin display satisfactory functions as a covering film for the pigment particle, or as a coating film in the ink composition.

The resin may itself have a self-dispersing capability or solubility, or these functions may be added or introduced. For example, it is possible to use a resin having an introduced carboxyl group, sulfonic acid group, or phosphonic acid group or another anionic group, by neutralizing with an organic amine or alkali metal. Moreover, it is also possible to use a resin into which one or two or more anionic groups of the same type or different types have been introduced. In the embodiment of the present invention, it is desirable to use a resin which has been neutralized by means of a salt and which contains an introduced carboxyl group.

There are no particular restrictions on the pigment used in the present embodiment, and specific examples of orange and yellow pigments are: C.I. Pigment Orange 31, C.I. Pigment Orange 43, C.I. Pigment Yellow 12, C.I. Pigment Yellow 13, C.I. Pigment Yellow 14, C.I. Pigment Yellow 15, C.I. Pigment Yellow 17, C.I. Pigment Yellow 74, C.I. Pigment Yellow 93, C.I. Pigment Yellow 94, C.I. Pigment Yellow 128, C.I. Pigment Yellow 138, C.I. Pigment Yellow 151, C.I. Pigment Yellow 155, C.I. Pigment Yellow 180, and C.I. Pigment Yellow 185.

Specific examples of red and magenta pigments are: C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48:1, C.I. Pigment Red 53:1, C.I. Pigment Red 57:1, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178, and C.I. Pigment Red 222.

Specific examples of green and cyan pigments are: C.I. Pigment Blue 15, C.I. Pigment Blue 15:2, C.I. Pigment Blue 15:3, C.I. Pigment Blue 16, C.I. Pigment Blue 60, and C.I. Pigment Green 7.

Specific examples of a black pigment are: C.I. Pigment Black 1, C.I. Pigment Black 6, and C.I. Pigment Black 7.

It is desirable in the present embodiment that the ink contains polymer particles that do not contain any colorant, as a component for reacting with the treatment liquid. The polymer particles can improve the image quality by strengthening the ink viscosity raising action and the aggregating action through reaction with the treatment liquid. In particular, a highly stable ink can be obtained by adding anionic polymer particles to the ink.

By using the ink containing the polymer particles that produce the viscosity raising action and the aggregating action through reaction with the treatment liquid, it is possible to increase the quality of the image, and at the same time, depending on the type of polymer particles, the polymer particles may form a film on the recording medium, and therefore beneficial effects can be obtained in improving the wear resistance and the waterproofing characteristics of the image.

The method of dispersing the polymer particles in the ink is not limited to adding an emulsion of the polymer particles to the ink, and the resin may also be dissolved, or included in the form of a colloidal dispersion, in the ink.

The polymer particles may be dispersed by using an emulsifier, or the polymer particles may be dispersed without using any emulsifier. For the emulsifier, a surface active agent of low molecular weight is generally used, and it is also possible to use a surface active agent of high molecular weight. It is also desirable to use a capsule type of polymer particles having an outer shell composed of acrylic acid, methacrylic acid, or the like (core-shell type of polymer particles in which the composition is different between the core portion and the outer shell portion).

The polymer particles dispersed without any surface active agent of low molecular weight are known as the soap-free latex, which includes polymer particles with no emulsifier or a surface active agent of high molecular weight. For example, the soap-free latex includes polymer particles that use, as an emulsifier, the above-described polymer having a water-soluble group, such as a sulfonic acid group or carboxylic acid group (a polymer with a grafted water-soluble group, or a block polymer obtained from a monomer having a water-soluble group and a monomer having an insoluble part).

It is especially desirable in the present embodiment to use the soap-free latex compared to other type of resin particles obtained by polymerization using an emulsifier, since there is no possibility that the emulsifier inhibits the aggregating reaction and film formation of the polymer particles, or that the free emulsifier moves to the surface after film formation of the polymer particles and thereby degrades the adhesive properties between the recording medium and the ink aggregate in which the coloring material and the polymer particles are combined.

Examples of the resin component added as the resin particles to the ink include: an acrylic resin, a vinyl acetate resin, a styrene-butadiene resin, a vinyl chloride resin, an acryl-styrene resin, a butadiene resin, and a styrene resin.

In order to make the polymer particles have high speed aggregation characteristics, it is desirable that the polymer particles contain a carboxylic acid group having a low degree of disassociation. Since the carboxylic acid group is readily affected by change of pH, then the polymer particles containing the carboxylic acid group easily change the state of the dispersion and have high aggregation characteristics.

The change in the dispersion state of the polymer particles caused by change in the pH can be adjusted by means of the component ratio of the polymer particle having a carboxylic acid group, such as ester acrylate, or the like, and it can also be adjusted by means of an anionic surfactant which is used as a dispersant.

Desirably, the resin constituting the polymer particles is a polymer that has both of a hydrophilic part and a hydrophobic part. By incorporating a hydrophobic part, the hydrophobic part is oriented toward to the inner side of the polymer particle, and the hydrophilic part is oriented efficiently toward the outer side, thereby having the effect of further increasing the change in the dispersion state caused by change in the pH of the liquid. Therefore, aggregation can be performed more efficiently.

Examples of commercially available resin emulsion include: Joncryl 537 and 7640 (styrene-acrylic resin emulsion, manufactured by Johnson Polymer), Microgel E-1002 and E-5002 (styrene-acrylic resin emulsion, manufactured by Nippon Paint), Voncoat 4001 (acrylic resin emulsion, manufactured by Dainippon Ink and Chemicals), Voncoat 5454 (styrene-acrylic resin emulsion, manufactured by Dainippon Ink and Chemicals), SAE-1014 (styrene-acrylic resin emulsion, manufactured by Zeon Japan), Jurymer ET-410 (acrylic resin emulsion, manufactured by Nihon Junyaku), Aron HD-5 and A-104 (acrylic resin emulsion, manufactured by Toa Gosei), Saibinol SK-200 (acrylic resin emulsion, manufactured by Saiden Chemical Industry), and Zaikthene L (acrylic resin emulsion, manufactured by Sumitomo Seika Chemicals). However, the resin emulsion is not limited to these examples.

The weight ratio of the polymer particles to the pigment is desirably 2:1 through 1:10, and more desirably 1:1 through 1:3. If the weight ratio of the polymer particles to the pigment is less than 2:1, then there is no substantial improvement in the aggregating force of the aggregate formed by the cohesion of the polymer particles. On the other hand, if the weight ratio of the polymer particles to the pigment is greater than 1:10, the viscosity of the ink becomes too high and the ejection characteristics, and the like, deteriorate.

From the viewpoint of the adhesive force after the cohesion, it is desirable that the molecular weight of the polymer particles added to the ink is no less than 5,000. If it is less than 5,000, then beneficial effects are insufficient in terms of improving the internal aggregating force of the ink aggregate, achieving good fixing characteristics after transfer to the recording medium, and improving the image quality.

Desirably, the volume-average particle size of the polymer particles is in the range of 10 nm to 1 μm, more desirably, the range of 10 nm to 500 nm, even desirably 20 nm to 200 nm and particularly desirably, the range of 50 nm to 200 nm. If the particle size is not more than 10 nm, then significant effects in improving the image quality or enhancing transfer characteristics cannot be expected, even if aggregation occurs. If the particle size is not smaller than 1 μm, then there is a possibility that the ejection characteristics from the ink head or the storage stability will deteriorate. Furthermore, there are no particular restrictions on the volume-average particle size distribution of the polymer particles and they may have a broad volume-average particle size distribution or they may have a monodisperse volume-average particle size distribution.

Moreover, two or more types of polymer particles may be used in combination in the ink.

Examples of the pH adjuster added to the ink in the present embodiment include an organic base and an inorganic alkali base, as a neutralizing agent. In order to improve storage stability of the ink for inkjet recording, the pH adjuster is desirably added in such a manner that the ink for inkjet recording has the pH of 6 through 10.

<Water-Soluble Solvent>

It is desirable in the present embodiment that the aqueous ink contains the following water-soluble solvent.

The ink uses the water-soluble solvent for the purpose of a drying prevention agent, wetting agent or permeation promoting agent. In particular, in the case of the aqueous ink used in the inkjet recording method, it is desirable to use an organic water-soluble solvent, for the purpose of a drying prevention agent, wetting agent or permeation promoting agent.

A drying prevention agent or wetting agent is used with a view to preventing blockages caused by drying of the inkjet ink in the ink ejection ports of the nozzles, and it is desirable to use an organic water-soluble solvent having a lower vapor pressure than water as the drying prevention agent or wetting agent.

Furthermore, it is also preferable to use an organic water-soluble solvent as a permeation promotion agent, in order that the ink (the inkjet ink composition in particular) permeates more satisfactorily into the paper.

In the present embodiment, in order to suppress curl, (a) the water-soluble solvent contains 90 wt % or more of water-soluble solvent having the SP value of 27.5 or lower, and contains a compound expressed by the structural formula (1) below.

Here, the "water-soluble solvent having the SP value of 27.5 or lower" and the "compound expressed by the structural formula (1)" may be the same substance or different substances.

The SP value (solubility parameter) of the water-soluble solvent described here is a value expressed as the square root of the molecular aggregation energy, and this value can be calculated by the method described by R. F. Fedors in Polymer Engineering Science, 14, p. 147 (1974). The unit is $(MPa)^{1/2}$ and indicates the value at 25° C.

Structural formula (1)

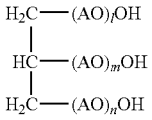

In the structural formula (1), l, m and n are respective and independent natural numbers, and l+m+n=3 to 15.

If l+m+n is less than 3, the curl suppressing force is low, and if this sum is greater than 15, then the ejection characteristics decline.

In the foregoing, desirably, l+m+n is 3 to 12, and more desirably, 3 to 10.

In the structural formula (1), AO represents ethylene oxy and/or propylene oxy, and of these, a propylene oxy group is desirable.

The AO in $(AO)_l$, $(AO)_m$ and $(AO)_n$ may be respectively the same or different.

Examples of water-soluble solvents having the above-described structure and an SP value of 27.5 or lower are listed as follows, together with their SP values in parentheses.

diethylene glycol monoethyl ether (22.4)
diethylene glycol monobutyl ether (21.5)
triethylene glycol monobutyl ether (21.1)
dipropylene glycol monomethyl ether (21.3)
dipropylene glycol (27.2)

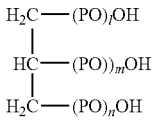

l + m + n = 3 (26.4)

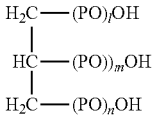

l + m + n = 4 (24.9)

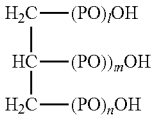

l + m + n = 5 (23.9)

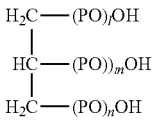

l + m + n = 6 (23.2)

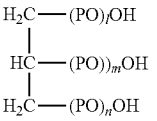

l + m + n = 7 (22.6)

$nC_4H_9O(AO)_4$—H (AO=EO or PO, ratio 1:1) (20.1)
EO=ethylene oxy (oxyethylene)
$nC_4H_9O(AO)_{10}$—H (as above) (18.8)
$HO(A'O)_{40}$—H (A'O=EO or PO, ratio EO:PO=1:3) (18.7)
$HO(A''O)_{55}$—H (A"O=EO or PO, ratio EO:PO=5:6) (18.8)
$HO(PO)_3H$ (24.7)
$HO(PO)_7H$ (21.2)
1,2 hexanediol (27.4)

The ratio (content) of the compound expressed by the structural formula (1) in the water-soluble solvent is desirably 10% or greater, more desirably, 30% or greater and even more desirably, 50% or greater. No problems occur, even if a high value is adopted. Using a value in the above-described ranges is desirable, since this makes it possible to suppress curl without degrading the stability or ejection characteristics of the ink.

Furthermore, in embodiments of the present invention, other solvents can be used additionally, in a range where the ratio of solvent having an SP value of 27.5 or lower does not become lower than 90%.

Examples of the additionally used water-soluble organic solvent are: alkane diols (polyhydric alcohols) such as glycerin, 1,2,6-hexanetriol, trimethylolpropane, ethylene glycol, propylene glycol, diethylene glycol, triethylene glycol, tetraethylene glycol, pentaethylene glycol, dipropylene glycol, 2-butene-1,4-diol, 2-ethyl-1,3-hexanediol, 2-methyl-2,4-pentanediol, 1,2-octanediol, 1,2-hexanediol, 1,2-pentanediol, and 4-methyl-1,2-pentanediol; sugars such as glucose, mannose, fructose, ribose, xylose, arabinose, galactose, aldonic acid, glucitol (sorbit), maltose, cellobiose, lactose, sucrose, trehalose, and maltotriose; sugar alcohols; hyaluronic acids; the so-called solid wetting agents such as urea; alkyl alcohols having 1 to 4 carbon atoms such as ethanol, methanol, butanol, propanol, and isopropanol, glycol ethers such as ethylene glycol monomethyl ether, ethylene glycol monoethyl ether, ethylene glycol monobutyl ether, ethylene glycol monomethyl ether acetate, diethylene glycol monomethyl ether, diethylene glycol monoethyl ether, diethylene glycol mono-n-propyl ether, ethylene glycol mono-iso-propyl ether, diethylene glycol mono-iso-propyl ether, ethylene glycol mono-n-butyl ether, ethylene glycol mono-t-butyl ether, diethylene glycol mono-t-butyl ether, 1-methyl-1-methoxybutanol, propylene glycol monomethyl ether, propylene glycol monoethyl ether, propylene glycol mono-n-butyl ether, propylene glycol mono-n-propyl ether, propylene glycol mono-iso-propyl ether, dipropylene glycol monomethyl ether, dipropylene glycol monoethyl ether, dipropylene glycol mono-n-propyl ether, and dipropylene glycol mono-iso-propyl ether; 2-pyrrolidone, N-methyl-2-pyrrolidone, 1,3-dimethyl-2-imidazolidinone, formamide, acetamide, dimethylsulfoxide, sorbit, sorbitan, acetin, diacetin, triacetin, and sulfolan. These compounds can be used individually or in combinations of two or more thereof.

A polyhydric alcohol is useful as a drying preventing agent or a wetting agent. Examples of suitable polyhydric alcohols include glycerin, ethylene glycol, diethylene glycol triethylene glycol, propylene glycol, dipropylene glycol, tripropylene glycol, 1,3-butanediol, 2,3-butanediol, 1,4-butanediol, 3-methyl-1,3-butanediol, 1,5-pentanediol, tetraethylene glycol, 1,6-hexanediol, 2-methyl-2,4-pentanediol, polyethylene glycol, 1,2,4-butanetriol, and 1,2,6-hexanetriol. These alcohols can be used individually or in combinations of two or more thereof.

A polyol compound is preferred as a penetrating agent. Examples of aliphatic diols include 2-ethyl-2-methyl-1,3-propanediol, 3,3,-dimethyl-1,2,-butanediol, 2,2-diethyl-1,3-propanediol, 2-methyl-2-propyl-1,3-propanediol, 2,4-dimethyl-2,4-pentanediol, 2,5-dimethyl-2,5-hexanediol, 5-hexene-1,2-diol, and 2-ethyl-1,3-hexanediol. Among them, 2-ethyl-1,3-hexanediol and 2,2,4-trimethyl-1,3-pentanediol are preferred.

The water-soluble organic solvents may be used individually or in mixtures of two or more thereof.

From the standpoint of ensuring stability and ejection characteristic, the content ratio of the water-soluble organic solvent in the ink is preferably not less than 1 wt % and not more than 60 wt %, more preferably not less than 5 wt % and not more than 40 wt %, yet more preferably not less than 10 wt % and not more than 30 wt %.

The amount of water added to the ink is not particularly limited; however, from the standpoint of ensuring stability and ejection characteristic, it is preferably not less than 10 wt % and not more than 99 wt %, more preferably not less than 30 wt % and not more than 80 wt %, and yet more preferably not less than 50 wt % and not more than 70 wt %.

<Surfactant>

The ink according to the present embodiment may contain a surfactant.

Examples of the surfactant in the ink include: in a hydrocarbon system, an anionic surfactant, such as a salt of a fatty acid, an alkyl sulfate ester salt, an alkyl benzene sulfonate salt, an alkyl naphthalene sulfonate salt, a dialkyl sulfosuccinate salt, an alkyl phosphate ester salt, a naphthalene sulfonate/formalin condensate, and a polyoxyethylene alkyl sulfonate ester salt; and a non-ionic surfactant, such as a polyoxyethylene alkyl ether, a polyoxyethylene alkyl aryl ether, a polyoxyethylene fatty acid ester, a sorbitan fatty acid ester, a polyoxyethylene sorbitan fatty acid ester, a polyoxyethylene alkyl amine, a glycerin fatty acid ester, and an oxyethylene oxypropylene block copolymer. Desirable examples of the surfactant further include: Surfynols (manufactured by Air Products & Chemicals), which is an acetylene-based polyoxyethylene oxide surfactant, and an amine oxide type of amphoteric surfactant, such as N,N-dimethyl-N-alkyl amine oxide.

Moreover, it is also possible to use the surfactants cited in Japanese Patent Application Publication No. 59-157636, pages 37 to 38, and Research Disclosure No. 308119 (1989). Furthermore, it is also possible to use a fluoride type (alkyl fluoride type), or silicone type of surfactant such as those described in Japanese Patent Application Publication Nos. 2003-322926, 2004-325707 and 2004-309806. It is also possible to use a surface tension adjuster of this kind as an anti-foaming agent; and a fluoride or silicone compound, or a chelating agent, such as ethylenediamine tetraacetic acid (EDTA), can also be used.

The surfactant contained in the ink has beneficial effects in raising the wettability on the solid or semi-solid aggregating treatment agent layer by reducing the surface tension, and therefore the aggregating action effectively progresses due to the increase in the contact surface area between the solid or semi-solid aggregating treatment agent layer and the ink.

It is desirable in the present embodiment that the ink has the surface tension of 10 mN/m through 50 mN/m. Moreover, from the viewpoint of simultaneously achieving good permeability into the permeable recording medium, formation of fine droplets and good ejection properties, it is more desirable that the ink has the surface tension of 15 mN/m through 45 mN/m.

Apart from the foregoing, according to requirements, it is also possible that the ink contains a pH buffering agent, an anti-oxidation agent, an antibacterial agent, a viscosity adjusting agent, a conductive agent, an ultraviolet absorbing agent, or the like.

Treatment Liquid

It is desirable in the present embodiment that the treatment liquid (aggregating treatment liquid) has effects of generating aggregation of the pigment and the polymer particles contained in the ink by producing a pH change in the ink when coming into contact with the ink.

Specific examples of the contents of the treatment liquid are: polyacrylic acid, acetic acid, glycolic acid, malonic acid, malic acid, maleic acid, ascorbic acid, succinic acid, glutaric acid, fumaric acid, citric acid, tartaric acid, lactic acid, sulfonic acid, orthophosphoric acid, pyrrolidone carboxylic acid, pyrone carboxylic acid, pyrrole carboxylic acid, furan carboxylic acid, pyridine carboxylic acid, cumaric acid, thiophene carboxylic acid, nicotinic acid, derivatives of these compounds, and salts of these.

A treatment liquid having added thereto a polyvalent metal salt or a polyallylamine is the preferred examples of the treatment liquid. The aforementioned compounds may be used individually or in combinations of two or more thereof.

From the standpoint of aggregation ability with the ink, the treatment liquid preferably has a pH of 1 to 6, more preferably a pH of 2 to 5, and even more preferably a pH of 3 to 5.

The amount of the component that causes aggregation of the pigment and polymer particles of the ink in the treatment liquid is preferably not less than 0.01 wt % and not more than 20 wt % based on the total weight of the liquid. Where the amount of this component is less than 0.01 wt %, sufficient concentration diffusion does not proceed when the treatment liquid and ink come into contact with each other, and sufficient aggregation action caused by pH variation sometimes does not occur. Further, where the amount of this component is more than 20 wt %, the ejection ability from the inkjet head can be degraded.

From the standpoint of preventing the nozzles of inkjet heads from being clogged by the dried treatment liquid, it is preferred that the treatment liquid include an organic solvent capable of dissolving water and other additives. A wetting agent and a penetrating agent are included in the organic solvent capable of dissolving water and other additives.

The solvents can be used individually or in a mixture of plurality thereof together with water and other additives.

The content ratio of the organic solvent capable of dissolving water and other additives is preferably not more than 60 wt % based on the total weight of the treatment liquid. Where this amount is higher than 60 wt %, the viscosity of the treatment liquid increases and ejection ability from the inkjet head can be degraded.

In order to improve fixing ability and abrasive resistance, the treatment liquid may further include a resin component. Any resin component may be employed, provided that the ejection ability from a head is not degraded when the treatment liquid is ejected by an inkjet system and also provided that the treatment liquid will have high stability in storage. Thus, water-soluble resins and resin emulsions can be freely used.

An acrylic resin, a urethane resin, a polyester, a vinyl resin, and a styrene resin can be considered as the resin components. In order to demonstrate a sufficient function of improving the fixing ability, a polymer with a comparatively high molecular weight has to be added at a high concentration of 1 wt % to 20 wt %. However, where such a material is added to and dissolved in a liquid, the viscosity thereof increases and ejection ability is degraded. A latex can be effectively added as an adequate material that can be added to a high concentration, while inhibiting the increase in viscosity. Examples of latex materials include alkyl acrylate copolymers, carboxy-modified SBR (styrene-butadiene latex), SIR (styrene-isoprene) latex, MBR (methyl methacrylate-butadiene latex), and NBR (acrylonitrile-butadiene latex). From the standpoint of the process, the glass transition temperature Tg of the latex has a strong effect during fixing, and is desirably not lower than 40° C. and not higher than 120° C. Furthermore, from the standpoint of the process, the minimum film-formation temperature MFT also has a strong effect during fixing, and in order to obtain sufficient fixing at a low temperature, it is preferred that the MFT be not higher than 100° C., more preferably not higher than 50° C.

The aggregation ability may be further improved by introducing polymer microparticles of reverse polarity with respect to that of the ink into the treatment liquid and causing the aggregation of the pigment contained in the ink with the polymer microparticles.

The aggregation ability may be also improved by introducing a curing agent corresponding to the polymer microparticle component contained in the ink into the treatment liquid, bringing the two liquids into contact, causing aggregation and also crosslinking or polymerization of the resin emulsion in the ink component.

The treatment liquid used in the present embodiment can include a surfactant.

Examples of suitable surfactants of a hydrocarbon system include anionic surfactants such as fatty acid salts, alkylsulfuric acid esters and salts, alkylbenzenesulfonic acid salts, alkylnaphthalenesulfonic acid salts, dialkylsulfosuccinic acid salts, alkylphosphoric acid esters and salts, naphthalenesulfonic acid formalin condensate, and polyoxyethylene alkylsulfuric acid esters and salts, and nonionic surfactants such as polyoxyethyelene alkyl ethers, polyoxyethylene alkylallyl ethers, polyoxyethylene fatty acid esters, sorbitan fatty acid esters, polyoxyethylene sorbitan fatty acid esters, polyoxyethylene alkylamines, glycerin fatty acid esters, and oxyethylene oxypropylene block copolymer. It is preferred that SURFYNOLS (made by Air Products & Chemicals), which is an acetylene-type polyoxyethylene oxide surfactant, be used. Amineoxide-type amphoteric surfactant such as N,N-dimethyl-N-alkylamineoxide is also a preferred surfactant.

A surfactant described in Japanese Patent Application Publication No. 59-157636, pages 37 to 38 and Research Disclosure No. 308119 (1989) can be also used. Fluorine-containing (fluorinated alkyl system) and silicone-type surfactants such as described in Japanese Patent Application Publication Nos. 2003-322926, 2004-325707, and 2004-309806 can be also used. These surface tension adjusting agents can be also used as an antifoaming agent. Chelating agents represented by fluorine-containing or silicone-type compounds and EDTA can be also used.

These agents are effective in reducing surface tension and increasing wettability on the recording medium. Further, even when the ink is the first to be deposited, effective aggregation action proceeds because of increased wettability of the ink and enlarged contact surface area of the two liquids.

It is desirable in the present embodiment that the treatment liquid has the surface tension of 10 mN/m through 50 mN/m. Moreover, from the viewpoint of simultaneously achieving good permeability into the permeable recording medium, formation of fine droplets and good ejection properties, it is more desirable that the treatment liquid has the surface tension of 15 mN/m through 45 mN/m.

It is desirable in the present embodiment that the treatment liquid has the viscosity of 1.0 mPa·s through 20.0 mPa·s.

Apart from the foregoing, according to requirements, it is also possible that the treatment liquid contains a pH buffering agent, an anti-oxidation agent, an antibacterial agent, a viscosity adjusting agent, a conductive agent, an ultraviolet absorbing agent, or the like.

Recording Medium (Paper)

There are no particular restrictions on the recording medium used in the present embodiment; however, particularly desirable results can be obtained with coated printing papers, which have a slow rate of permeation of the ink solvent.

Possible examples of support media which can be used appropriately for coated paper are: a base paper manufactured using a Fourdrinier paper machine, cylindrical-wire paper machine, twin-wire paper machine, or the like, from main components of wood pulp or pigment, the pulp being either a chemical pulp such as LBKP or NBKP, a mechanical pulp, such as GP, PGW, RMP, TMP, CTMP, CMP, CGP, or the like, or recovered paper pulp, such as DIP, and the main components being mixed with one or more additive of a sizing agent, fixing agent, yield enhancer, cationization agent, paper strength enhancer, or the like, or a base paper provided with a size press layer or anchor coating layer formed using starch, polyvinyl alcohol, or the like, or an art paper, coated paper, or cast coated paper, or the like, formed by providing a coating layer on top of the size press layer or anchor coating layer.

In the present embodiment, it is possible to use these base papers or coated papers directly without alteration, and it is also possible to use these papers after carrying out a calendering process using a machine calender, TG calender, soft calender, or the like, and thereby controlling the surface smoothness of the paper.

There are no particular restrictions on the weight of the support medium, although generally the weight is approximately 40 g/m$^2$ to 300 g/m$^2$. The coated paper used in the present embodiment has the coating layer formed on the support medium described above. The coating layer includes a coating composition having a main component of pigment and binder, and at least one layer thereof is formed on the support medium.

For the pigment, it is desirable to use a white pigment. Possible examples of the white pigment are: an inorganic pigment, such as precipitated calcium carbonate, heavy calcium carbonate, magnesium carbonate, kaolin, talc, calcium sulfate, barium sulfate, titanium dioxide, zinc oxide, zinc sulfide, zinc carbonate, satin white, aluminum silicate, diatomaceous earth, calcium silicate, magnesium silicate, synthetic non-crystalline silica, colloidal silica, alumina, colloidal alumina, pseudo-boehmite, aluminum hydroxide, lithopone, zeolite, hydrated halloysite, magnesium hydroxide, or the like; or an organic pigment, such as a styrene-based plastic pigment, an acrylic plastic pigment, polyethylene, microcapsules, urea resin, melamine resin, or the like.

Possible examples of the binder are: a starch derivative, such as oxidized starch, etherified starch, or phosophoric acid esterized starch; a cellulose derivative, such as carboxymethyl cellulose, hydroxyethyl cellulose, or the like; casein, gelatine, soybean protein, polyvinyl alcohol, or derivatives of same; polyvinyl alcohols having various degrees of saponification or silanol-denatured versions of same, or carboxylates, cationized products, of other derivatives of same; polyvinyl pyrrolidone, maleic anhydride resin, a styrene-butadiene copolymer, a methyl methacrylate-butadiene copolymer, or other conjugated diene copolymer latex; an acrylic polymer latex, such as a polymer or copolymer of acrylate ester and methacrylate ester; a vinyl polymer latex, such as such as an ethylene acetate vinyl copolymer; or a functional group-denatured polymer latex based on these various polymers and a monomer containing a functional group such as a carboxy group; an aqueous adhesive of a heat-curable synthetic resin, such as melamine resin, urea resin, or the like; an acrylate ester such as polymethylmethacrylate; methacrylate ester polymer or copolymer resin, such as methacrylate ester; or a synthetic resin-based adhesive, such as polyurethane resin, unsaturated polyester resin, vinyl chloride-vinyl acetate copolymer, polyvinyl butylal, alkyd resin, or the like.

The combination ratio of the pigment and binder in the coating layer is 3 to 70 parts by weight, and desirably 5 to 50 parts by weight, of binder with respect to 100 parts by weight of pigment. If the combination ratio of the binder with respect to 100 parts by weight of pigment is less than 3 parts by weight, then the coating of the ink receiving layer by the coating composition will have insufficient strength. On the other hand, if the combination ratio is greater than 70 parts by weight, then the absorption of high-boiling-point solvent is slowed dramatically.

Moreover, it is also possible to combine various additives in appropriate fashion in the coating layer, such as: a dye fixing agent, a pigment dispersant, a viscosity raising agent, a fluidity enhancer, an antifoaming agent, a foam suppressant, a separating agent, a foaming agent, a permeating agent, a coloring dye, a coloring pigment, a fluorescent brightener, an ultraviolet light absorber, an antioxidant, an anticorrosive, an antibacterial agent, a waterproofing agent, a wet paper strength enhancer, a dry paper strength enhancer, or the like.

The application amount of the ink receiving layer varies depending on the required luster, the ink absorbing properties and the type of support medium, or the like, and although no general figure can be stated, it is normally 1 g/m$^2$ or greater. Furthermore, the ink receiving layer can also be applied by dividing a certain uniform application amount into two application steps. If application is divided into two steps in this way, then the luster is raised in comparison with a case where the same application amount is applied in one step.

The application of the coating layer can be carried out using one of various types of apparatus, such as a blade coater, roll coater, air knife coater, bar coater, rod blade coater; curtain coater, short dowel coater, size press, or the like, in on-machine or off-machine mode. Furthermore, after application of the coating layer, it is also possible to carry out a smoothing and finishing process on the ink receiving layer by using a calender apparatus, such as a machine calender, a TG calender, a soft calender, or the like. The number of coating layers can be determined appropriately in accordance with requirements.

The coating paper may be an art paper, high-quality coated paper, medium-quality coated paper, high-quality lightweight coated paper, medium-quality lightweight coated paper, or light-coated printing paper; the application amount of the coating layer is around 40 g/m$^2$ on both surfaces in the case of art paper, around 20 g/m$^2$ on both surfaces in the case of high-quality coated paper or medium-quality coated paper, around 15 g/m$^2$ on both surfaces in the case of high-quality lightweight coated paper or medium-quality lightweight coated paper, and 12 g/m$^2$ or less on both surfaces in the case of a light-coated printing paper. An example of an art paper is Tokubishi Art, or the like; an example of a high-quality coated paper is "Urite"; examples of art papers are Tokubishi Art (made by Mitsubishi Paper Mills), Golden Cask Satin (made by Oji Paper), or the like; examples of coated papers are OK Top Coat (made by Oji Paper), Aurora Coat (made by Nippon Paper Group), Recycle Coat T-6 (made by Nippon Paper Group); examples of lightweight coated papers are Urite (made by Nippon Paper Group), New V Matt (made by Mitsubishi Paper Mills), New Age (made by Oji Paper), Recycle Mat T-6 (made by Nippon Paper Group), and "Pism" (made by Nippon Paper Group). Examples of light-coated printing papers are Aurora L (made by Nippon Paper Group) and Kinmari Hi-L (made by Hokuetsu Paper Mills), or the like. Moreover, examples of cast coated papers are: SA Gold Cask plus (made by Oji Paper), Hi-McKinley Art (Gojo Paper Manufacturing), or the like.

Image Forming Apparatus

With reference to FIG. 1, the fundamental procedure of the image forming method according to an embodiment of the present invention is described. FIG. 1 is a schematic drawing of an image forming apparatus used in an image forming method according to an embodiment of the present invention.

The image forming apparatus (inkjet recording apparatus) 10 shown in FIG. 1 includes, in order from the upstream side in the direction of conveyance of a recording medium 12 (the sub-scanning direction): a treatment liquid deposition unit 14, a treatment liquid drying unit 16, an ink droplet ejection unit 18, an ink drying unit 20, and a fixing unit 22.

The recording medium 12 is held on an endless conveyance belt 28 wound about rollers 24 and 26, and is conveyed from the left-hand side to the right-hand side in the drawing. The conveyance method of the recording medium 12 is not limited in particular to the belt conveyance method shown in FIG. 1, and it is possible to use various methods such as a drum conveyance method where the recording medium 12 is held and conveyed on a surface (circumferential surface) of a drum-shaped member. The drum conveyance method is described later.

The treatment liquid deposition unit 14 deposits the treatment liquid onto the recording medium 12 before the deposition of ink droplets by the ink droplet ejection unit 18, which is arranged to the downstream side in the sub-scanning direction. There are no particular restrictions on the method of depositing the treatment liquid, and for example, it is possible to employ an application method using an application roller, or the like, or a spraying method, an inkjet recording method, or other methods of various types. In these, it is desirable to deposit droplets of the treatment liquid on the recording medium through a recording head (inkjet head) of the inkjet recording method, since it is possible to selectively deposit the treatment liquid onto only an area where the ink droplets are deposited, so that the drying duration can be shortened and the required heating energy can be reduced.

The treatment liquid drying unit 16 is disposed to the downstream side of the treatment liquid deposition unit 14 in terms of the sub-scanning direction, whereby the treatment liquid that has been deposited on the recording medium 12 is dried. It is desirable to thereby form a solid or semi-solid treatment liquid (hereinafter, this dried treatment liquid layer is referred to as an aggregating agent layer 40') on the surface of the recording medium 12. In this case, it is desirable to dry the treatment liquid so that the aggregating agent layer 40' has a thickness of not greater than 1 μm. Thereby, it is possible to prevent image deterioration due to movement of the coloring material (floating of the dots) in the treatment liquid layer, as described below.

There are no particular restrictions on the method used to dry the treatment liquid, and for example, desirably, a hot air drying method is adopted in which a hot air drying device of which the temperature and air flow rate can be controlled within a prescribed range is provided and a hot air flow is blown onto the treatment liquid on the recording medium 12. Furthermore, it is also desirable to adopt, either in conjunction with the hot air drying method described above, or independently, a rear surface heating method in which a heater (for example, a flat plate heater) 30 is arranged inside the conveyance belt 28 to heat the recording medium 12 from the rear surface side (the side opposite to the image forming surface).

In the present specification, the term of "solid or semi-solid aggregating treatment agent layer" includes an aggregating treatment agent layer having a solvent content rate of 0% to 70%, where the solvent content rate is defined as:

> "Solvent content rate"="Weight of solvent contained in treatment liquid after drying, per unit surface area (g/m$^2$)"/"Weight of treatment liquid after drying, per unit surface area (g/m$^2$)".

The term of "aggregating treatment agent" broadly includes the aggregating treatment agent of the solid or semi-solid state and the aggregating treatment agent in a liquid state. In particular, the aggregating treatment agent in the liquid state of which the solvent content rate is not less than 70% is referred to as an "aggregating treatment liquid" or simply to as a "treatment liquid".

As a method for calculating the solvent content rate of the treatment liquid, a sheet of paper (recording medium) of a prescribed size (for example 100 mm×100 mm) is cut out, the total weight of the paper after the deposition of the treatment liquid (the total weight of the paper and the deposited treatment liquid before drying) and the total weight of the paper after drying of the treatment liquid (the total weight of the paper and the deposited and dried treatment liquid) are measured respectively, and the reduction in the amount of solvent due to drying (the amount of solvent evaporated) is determined from the difference between the two weights. Furthermore, the amount of solvent contained in the treatment liquid before drying can be calculated from the treatment liquid preparation method. It is possible to obtain the solvent content rate from the result of these calculations.

Figure 2A:
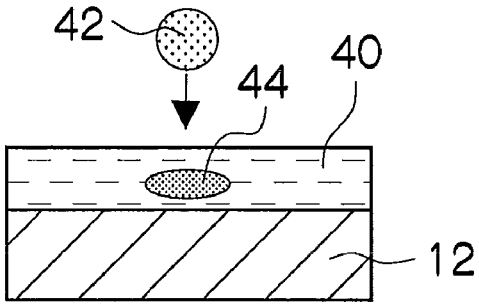
FIG.2A RELATED ART
FIG. 2A is a diagram showing a state of an ink droplet landing on a recording medium in the related art.
Figure 2B:
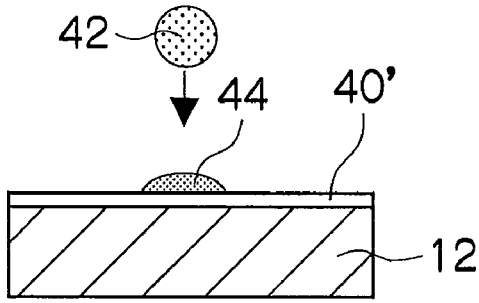
FIG. 2B is a diagram showing a state of an ink droplet landing on a recording medium according to an embodiment of the present invention.

As shown in FIG. 2A, if an ink droplet 42 is deposited in a state where a liquid layer of the treatment liquid (the liquid layer before drying) 40 is present on the surface of the recording medium 12, the ink coloring material (ink dot) 44 floats and moves in the liquid layer 40, giving rise to deterioration of the image quality. In the present embodiment, as shown in FIG. 2B, the treatment liquid is dried on the recording medium 12 before an ink droplet 42 is ejected, thereby forming the solid or semi-solid aggregating treatment agent layer 40' on the recording medium 12. Hence, the ejected ink droplet 42 lands on the solid or semi-solid aggregating treatment agent layer 40', and the ink coloring material (ink dot) 44 is deposited on the surface of the solid or semi-solid aggregating treatment agent layer 40'. Since the aggregating reaction occurs in the vicinity of the contact surface, and the coloring material in the ink droplet aggregates while the ink droplet obtains an adhesive force in the prescribed contact interface area upon landing of the ink droplet, then image deterioration due to movement of the coloring material (floating of the dots) is suppressed.

As shown in FIG. 1, the ink droplet ejection unit 18 is provided with inkjet type recording heads (hereinafter referred to as "ink ejection heads") 18C, 18M, 18Y and 18K, which correspond to the respective colored inks of cyan (C), magenta (M), yellow (Y) and black (K), and eject droplets of the corresponding colored inks from the nozzles of the ink ejection heads 18C, 18M, 18Y and 18K in accordance with the input image data. In the present embodiment, the ejection volume (droplet ejection volume) of the ink droplets ejected from the nozzles is 6 ng, and the recording density (droplet deposition density) is 1200 dpi in both the main scanning direction (the direction perpendicular to the conveyance direction of the recording medium 12) and the sub-scanning direction (the conveyance direction of the recording medium 12).

The ink drying unit 20 is disposed to the downstream side of the ink droplet ejection unit 18 in terms of the sub-scanning direction, and heats and dries the ink layer on the recording medium 12. Desirably, the ink drying method is a method (a hot air flow drying method) which blows heated air flow (a drying air flow) onto the ink layer on the recording medium 12, and the degree of drying can be controlled in accordance with the amount of water in the ink layer formed on the recording medium 12.

Figure 3A:
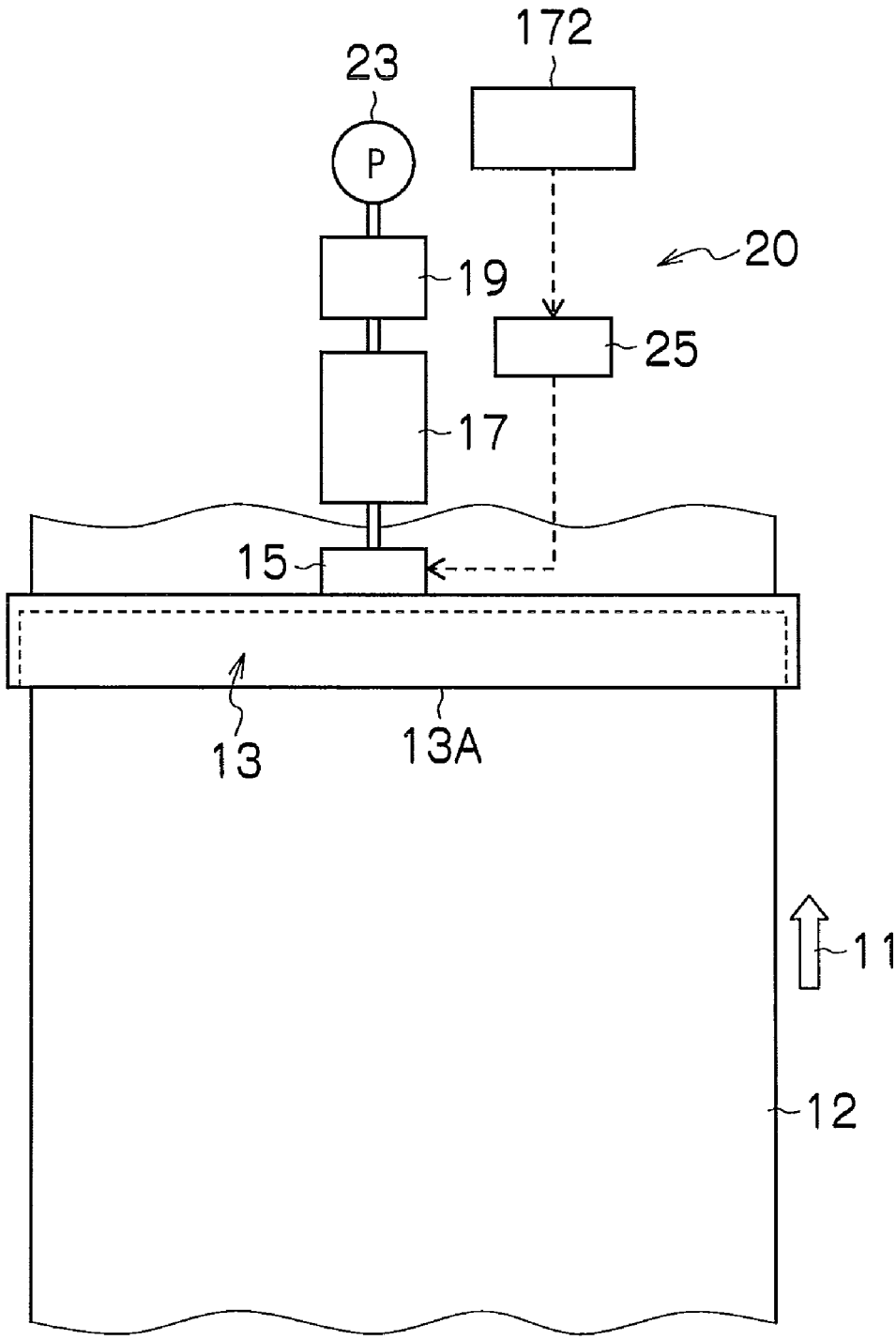
FIG. 3A is a general schematic drawing showing a mode of an ink drying unit which is capable of controlling the degree of drying of paper.

FIG. 3A is a conceptual diagram showing an ink drying unit 20 according to the present embodiment, and the ink drying unit 20 is composed in such a manner that the degree of drying is controlled in accordance with the amount of water in the ink layer formed on the recording medium 12.

An arrow 11 in FIG. 3A indicates the direction of conveyance of the recording medium 12.

As shown in FIG. 3A, an air nozzle 13, which blows a heated air flow onto the recording medium, is arranged above the recording medium 12 that is being conveyed, and a blowing port 13A having a length substantially equal to the width of the recording medium 12 is formed in the air nozzle 13. In FIG. 3A, the relationship between the recording medium 12 and the air nozzle 13 is depicted in a planar fashion, but the air nozzle 13 is disposed in such a manner that the heated air flow is blown substantially perpendicularly onto the surface of the recording medium 12.

The air nozzle 13 is connected to an air pump 23 through an electromagnetic valve 15, an air tank 17, a regulator 19 and an air pipe 21. A heater is provided in the air tank 17, and the air inside the air tank 17 is heated to create the heated air flow, and is blown out from the air nozzle 13. By this means, the air supplied from the air pump 23 is adjusted to a uniform pressure by the regulator 19, is temporarily trapped in the air tank 17, and is then blown out as the heated air flow from the air nozzle 13. In this blowing of the heated air flow, the heated air flow supplied from the air pump 23 to the air nozzle 13 is adjusted with good accuracy in the air tank 17 so as to achieve a prescribed pressure.

Desirably, the pressure of the air pump 23 is controlled to be approximately 0.2 MPa (or 0.1 MPa to 0.5 MPa).

The electromagnetic valve 15 is connected through an electromagnetic valve control unit 25 to a system controller 172 described later. Dot data prepared according to image data that has been converted by an image conversion unit is inputted to the system controller 172, which determines the droplet ejection volume of the droplets of aqueous ink ejected to be deposited onto the recording medium 12, and calculates the amount of water in the ink before drying on the recording medium 12 from the ink droplet ejection volume thus determined.

The system controller 172 controls the degree of opening of the electromagnetic valve 15 through the electromagnetic valve control unit 25 in accordance with the calculated water content of the ink before drying. More specifically, the degree of drying is controlled in accordance with the calculated water content of the ink in such a manner that the amount of water originating from the ink and still remaining on the recording medium after drying of the ink layer is not more than 4.0 g/m$^2$, and furthermore, if the calculated water content of the ink before drying is not less than 6.0 g/m$^2$, then the degree of drying is controlled in such a manner that the amount of water originating from the ink and still remaining on the recording medium after drying of the ink layer does not become less than 0.5 g/m$^2$.

When the amount of water remaining on the recording medium is controlled, then in addition to the amount of water originating from the ink, the amount of water originating from the treatment liquid and the amount of water originating from the recording medium 12 itself are also relevant; however, in the present invention, these have little effect on the amount of water remaining on the recording medium since the treatment liquid is dried to the solid or semi-solid state by the treatment liquid drying unit 16. Moreover, the amount of water originating from the recording medium 12 is small enough to be ignored. Consequently, there is no problem if the amount of water originating from the ink and still remaining on the recording medium is controlled by altering the degree of drying in accordance with the amount of water originating from the ink. Furthermore, since the amount of water originating from the ink can be obtained from the image information, then there is no need to measure the water content of the recording medium after the image formation. By this means, it is possible to automate the control of the degree of drying.

Preferably, a characteristic curve is beforehand prepared by experimentation, or the like, in respect of the relationship between the calculated amount of water in the ink, the amount of water remaining on the recording medium after the drying, and the degree of opening of the electromagnetic valve, and this characteristic curve data is input to the system controller 172.

By this means, it is possible to prevent offset onto the fixing member and curling of the recording medium in the two-liquid reaction method using the ink and treatment liquid.

In this case, as shown in FIG. 3A, it is possible to control the degree of drying in respect of the whole ink layer that is formed by depositing droplets of ink on the image region of the recording medium 12, and more desirably, the image region of the recording medium 12 is virtually divided into a plurality of portions so as to able to control the degree of drying respectively for each portion.

Figure 3B:
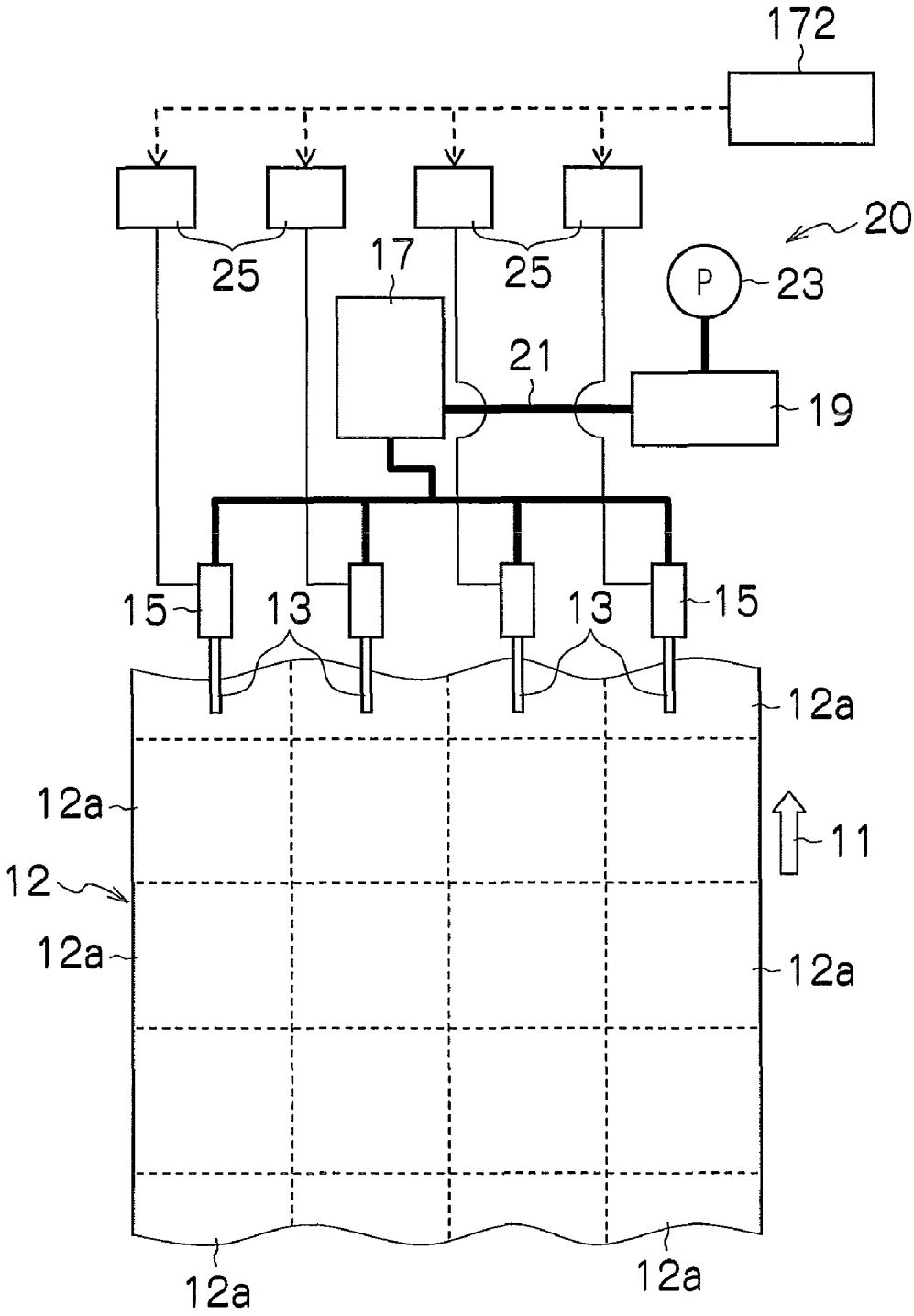
FIG. 3B is a general schematic drawing showing a mode of an ink drying unit which is capable of controlling the degree of drying for each of portions of paper.

FIG. 3B is a conceptual diagram showing the ink drying unit 20 according to another embodiment in which the degree of drying can be controlled in respect of each portion of the recording medium 12, and members which are the same as FIG. 3A are denoted with the same reference numerals.

As shown in FIG. 3B, the image region of the recording medium 12 is virtually divided into a plurality of portions 12*a* arranged in a lattice. The virtual divisions are defined on the coordinates data of the image information inputted from the host computer 186 (see FIG. 8) to the system controller 172 (see FIG. 8) which controls the whole of the image forming apparatus, and the coordinates data of the portions 12*a* are inputted to the ink drying unit 20.

FIG. 3B shows the case where the image region of the recording medium 12 is divided in the lattice, in such a manner that the areas of the respective portions 12*a* are the same. FIG. 3B shows the case where the image region of the recording medium 12 is divided into four columns in the conveyance direction of the recording medium 12 (sub-scanning direction), and the air nozzles 13 which blow the heated air flow are disposed above the conveyed recording medium so as to correspond respectively to the divided columns. In FIG. 3B, the image region is divided into the four columns, and therefore the four air nozzles 13 are provided.

The respective air nozzles 13 are connected to the air pump 23 though the electromagnetic valves 15, the air tank 17, the regulator 19 and the air pipe 21. A heater is provided in the air tank 17, and the air inside the air tank 17 is heated to create the heated air flow, and is blown out from the air nozzle 13. By this means, the air supplied from the air pump 23 is adjusted to a uniform pressure by the regulator 19, is temporarily trapped in the air tank 17, and is then blown out as the heated air flow from the air nozzles 13. In this blowing of the heated air flow, the heated air flow supplied from the air pump 23 to the air nozzles 13 is adjusted with good accuracy in the air tank 17 so as to achieve a prescribed pressure.

The pressure of the air pump 23 and the conveyance speed of the recording medium 12 are the same as in the case of FIG. 3A. Consequently, when the size of each portion 12*a* is taken as 150 mm in length by 150 mm in width and the heated air flow is blown from the air nozzles 13 from the leading end to the trailing end of the portion 12*a* in the direction of conveyance of the recording medium 12, then the blowing duration (drying duration) is 0.3 seconds.

The electromagnetic valves 15 are connected through the respective electromagnetic valve control units 25 to the system controller 172 described later. Dot data prepared according to image data that has been converted by an image conversion unit is inputted in association with the above-described coordinates data to the system controller 172, which determines the droplet ejection volume of the droplets of aqueous ink ejected to be deposited onto each of the respective portions 12*a*, and calculates the amount of water in the ink before drying on each of the respective portions 12*a* from the ink droplet ejection volume thus determined.

The system controller 172 controls the on/off switching of the electromagnetic valves 15 by controlling the electromagnetic valve control units 25 in accordance with the calculated amount of water of the ink before drying in each of the portions 12*a*. More specifically, in the portions where the amount of water is low, the time from switching on to off is shortened and hence the blown volume of the heated air flow is reduced. Conversely, in the portions where the amount of water is high, the time from switching on to off is lengthened and hence the blown volume of the heated air flow is increased. Preferably, the relationship between the amount of water and the time from switching on to switching off of the electromagnetic valve 15 is beforehand determined by experimentation, or the like.

By this means, it is possible to control the timing and duration of the blowing of the heated air flow for each of the portions 12*a* of the recording medium 12, and therefore it is possible to control the degree of drying for each of the portions 12*a*. More specifically, the degree of drying is controlled in accordance with the calculated water content of the ink in each portion 12*a* in such a manner that the amount of water remaining on the recording medium after drying of the ink layer is not more than 4.0 $g/m^2$, and furthermore, if the calculated water content of the ink is a large amount of 6.0 $g/m^2$ or greater, then the degree of drying is controlled in such a manner that the amount of water remaining on the recording medium after drying of the ink layer does not become less than 0.5 $g/m^2$.

In the case of the portion 12*a* where absolutely no image is formed, the electromagnetic valve 15 is switched off and a heated air flow is not blown from the air nozzle 13.

In FIGS. 3A and 3B, the flow rate of the heated air flow blown out from the air nozzles 13 is uniform, and the degree of drying in each of the portions 12*a* is controlled by controlling the duration of the blowing of the heated air flow; however, it is also possible to alter the flow rate of the blown air while maintaining the same duration of the blowing of the heated air flow. In this case, the blowing flow rate is set to zero in the case of the portion 12*a* in which absolutely no image is formed.

Thus, since the amount of water before drying in each of the portions 12*a* is calculated from the ink droplet ejection volume and the degree of drying is controlled in accordance with the calculated amount of water, then even in the case of printing a picture in which there is great variation in the ink deposition volume between respective portions on the recording medium 12, it is possible to suitably control the amount of remaining water in each of the portions 12*a*.

Furthermore, as shown in FIG. 1, it is also possible to use, in conjunction with the hot air drying method described above, a rear surface heating method in which a heater (for example, a flat plate heater) 32 is provided on the rear surface side of the recording medium 12 (the side opposite to the image forming surface) and the recording medium 12 is thereby heated from the rear surface side. In the present embodiment, the ink layer on the recording medium 12 is dried by blowing a heated air flow at 70° C. onto the front surface side of the recording medium 12 for a prescribed duration from the heated air flow drier (blower), while heating the rear surface side of the recording medium 12 to 60° C. by means of the heater 32. In this case, it is necessary to control the on/off switching of the electromagnetic valves 15 by taking account of drying by the heater 32.

As shown in FIG. 1, the fixing unit 22 is provided to the downstream side of the ink drying unit 20 in terms of the sub-scanning direction. In the fixing unit 22, the image formed on the recording medium 12 is fixed while heating and pressing the recording medium 12 by means of heating rollers 33 and 34 of which the temperature can be controlled in a prescribed range. For example, the heating rollers 33 and 34 make contact with the recording medium 12 at a pressure of 0.3 MPa and a temperature of approximately 75° C. By this means, it is possible to improve the fixing properties (wear resistance) of the image, and a desirable image quality can be obtained. Desirably, the heating temperature of the heating rollers 33 and 34 is set in accordance with the glass transition temperature of the polymer particles contained in the treatment liquid or the ink. Furthermore, it is also possible to provide heating rollers 33 and 34 in a plurality of stages in such a manner that the image formed on the recording medium 12 can be fixed in a stepwise fashion.

In the fixing unit 22, if the degree of drying in the ink drying unit 20 is not suitable, then offset occurs whereby the ink adheres to the heating roller 33. Furthermore, curl occurs in the recording medium 12 after leaving the fixing unit 22.

Next, the operation of the image forming apparatus 10 shown in FIG. 1 is described.

FIGS. 4A to 4D show schematic views of a situation from the deposition of treatment liquid onto the recording medium until the carrying out of fixing, and they depict partial exaggerated views of the state of forming an ink aggregate (coloring material aggregate). FIGS. 4A to 4D show a case where a coated paper for printing is used as the recording medium 12, and depict a state where a portion of the solvent in the treatment liquid or the ink has permeated into the recording medium 12.

Figure 4A:
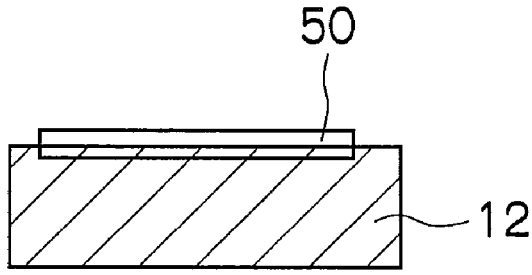
FIGS. 4A to 4D are diagrams showing the state from the deposition of treatment liquid onto the recording medium until the carrying out of fixing.

The recording medium 12 held on the conveyance belt 28 is conveyed in the sub-scanning direction (the left-hand side to the right-hand side in FIG. 1), and when the recording medium 12 passes a position opposing the treatment liquid deposition unit 14, the treatment liquid is deposited onto the recording medium 12 (treatment liquid deposition step). Then, when the recording medium 12 passes a position opposing the treatment liquid drying unit 16, the treatment liquid deposited on the recording medium 12 is heated and dried, and the solvent component (mainly water) of the treatment liquid on the recording medium 12 is evaporated (treatment liquid drying step). Thereby, as shown in FIG. 4A, the treatment liquid layer (desirably, the solid or semi-solid aggregating treatment agent layer) 50 is formed on the recording medium 12. It is desirable that the thickness of the aggregating treatment agent layer is not greater than 1 μm.

Figure 4B:
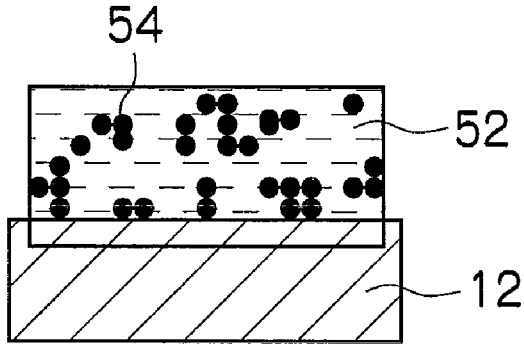

Thereupon, when the recording medium 12 passes a position opposing the ink droplet ejection unit 18, ink droplets of respective colors are ejected and deposited onto the recording medium 12 from the ink ejection heads 18C, 18M, 18Y and 18K (ink droplet ejection step). Thereby, as shown in FIG. 4B, the ink layer (the liquid layer composed of the mixture of the ink and the treatment liquid) 52 is formed on the recording medium 12. At this time, the ink aggregate (coloring material aggregate) 54 is formed in the ink layer 52 by reaction with the treatment liquid.

When the solid or semi-solid aggregating treatment agent layer has been formed on the recording medium 12, the ink droplets ejected from the ink ejection heads 18C, 18M, 18Y and 18K land on the surface of the solid or semi-solid aggregating treatment agent layer formed on the recording medium 12. At this time, the contact interface between each ink droplet and the aggregating treatment agent layer has a prescribed area when the ink droplet lands, due to a balance between the kinetic energy and the surface energy. The aggregating reaction starts immediately after the ink droplets have landed on the aggregating treatment agent, and the aggregating reaction starts from the surface of each ink droplet in contact with the aggregating treatment agent layer. Since the aggregating reaction occurs only in the vicinity of the contact surface, and the coloring material in the ink aggregates while the ink droplet obtains an adhesive force in the prescribed contact interface area upon landing of the ink droplet, then movement of the coloring material (movement of the dots) is suppressed.

Even if another ink droplet is subsequently deposited adjacently to the ink droplet deposited previously, since the coloring material of the previously deposited ink has already aggregated, then the coloring material does not mix with the subsequently deposited ink, and therefore bleeding is suppressed. After the aggregation of the coloring material, the separated ink solvent spreads, and a liquid layer (ink layer) containing dissolved aggregating treatment agent is formed on the recording medium 12.

Figure 4C:
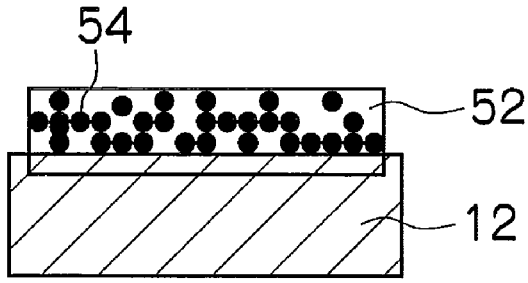

Subsequently, when the recording medium 12 passes a position opposing the ink drying unit 20, the ink layer 52 is heated and dried, and the solvent component (mainly water) of the ink layer 52 on the recording medium 12 is evaporated as shown in FIG. 4C (ink drying step).

Figure 4D:
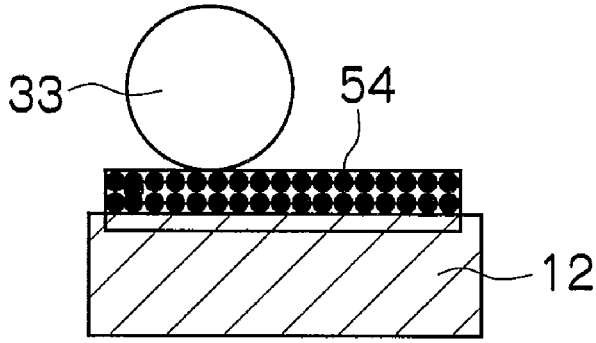

Thereafter, when the recording medium 12 passes the fixing unit 22, the recording medium 12 is heated and pressed by the heating roller 33 as shown in FIG. 4D, and the image formed on the recording medium 12 is thereby fixed (image fixing step).

If drying is insufficient from the treatment liquid deposition step until the fixing step so that the amount of water remaining in the ink layer 52 after drying by the ink drying step exceeds 4.0 g/m$^2$, then when the recording medium 12 passes the fixing unit 22, offset occurs whereby the ink adheres to the heating roller 33. Moreover, curl occurs in the recording medium 12 due to the large amount of remaining water.

Therefore, according to the present embodiment, in the ink drying unit 20, the degree of drying is controlled in such a manner that the amount of water remaining after drying in the ink layer formed on the recording medium 12 is not more than 4.0 g/m$^2$. Furthermore, if the amount of water in the ink layer before drying is a large amount of not less than 6.0 g/m$^2$, then the degree of drying is controlled in such a manner that the amount of remaining water does not become less than 0.5 g/m$^2$.

Thus, in the present embodiment, the thickness of the aggregating treatment agent layer is caused to become 1 μm or lower in the treatment liquid drying unit 16, and a suitable upper limit (4.0 g/m$^2$) and lower limit (0.5 g/m$^2$) are specified for the amount of water originating from the ink and still remaining after the drying in the ink drying unit 20, and therefore not only is it possible actively to suppress offset and curl, but it is also possible to suppress bleeding and floating of the dots, and an image of high quality can be formed.

Furthermore, if a hydrophilic substance having a solubility parameter (SP value) of 27.5 or lower, for example, trioxypropylene glyceryl ether, is used as the high-boiling-point solvent of the aqueous ink, it is possible to suppress curl of the recording medium 12 yet further.

In the ink drying step according to the present embodiment, desirably, the time period from the deposition of ink droplets onto the recording medium 12 until the carrying out of heating and drying (the ink droplet deposition/drying interval) is as short as possible. By rapidly evaporating off the solvent component (mainly water) of the ink layer 54 on the recording medium 12, it is possible to reduce the amount of water that permeates into the recording medium 12 and thereby reliably to prevent curl in the recording medium 12. Desirably, the ink droplet deposition/drying interval is 10 seconds or less, and more desirably, 1 second or less.

Image Forming Apparatus According to Another Embodiment

Figure 5:
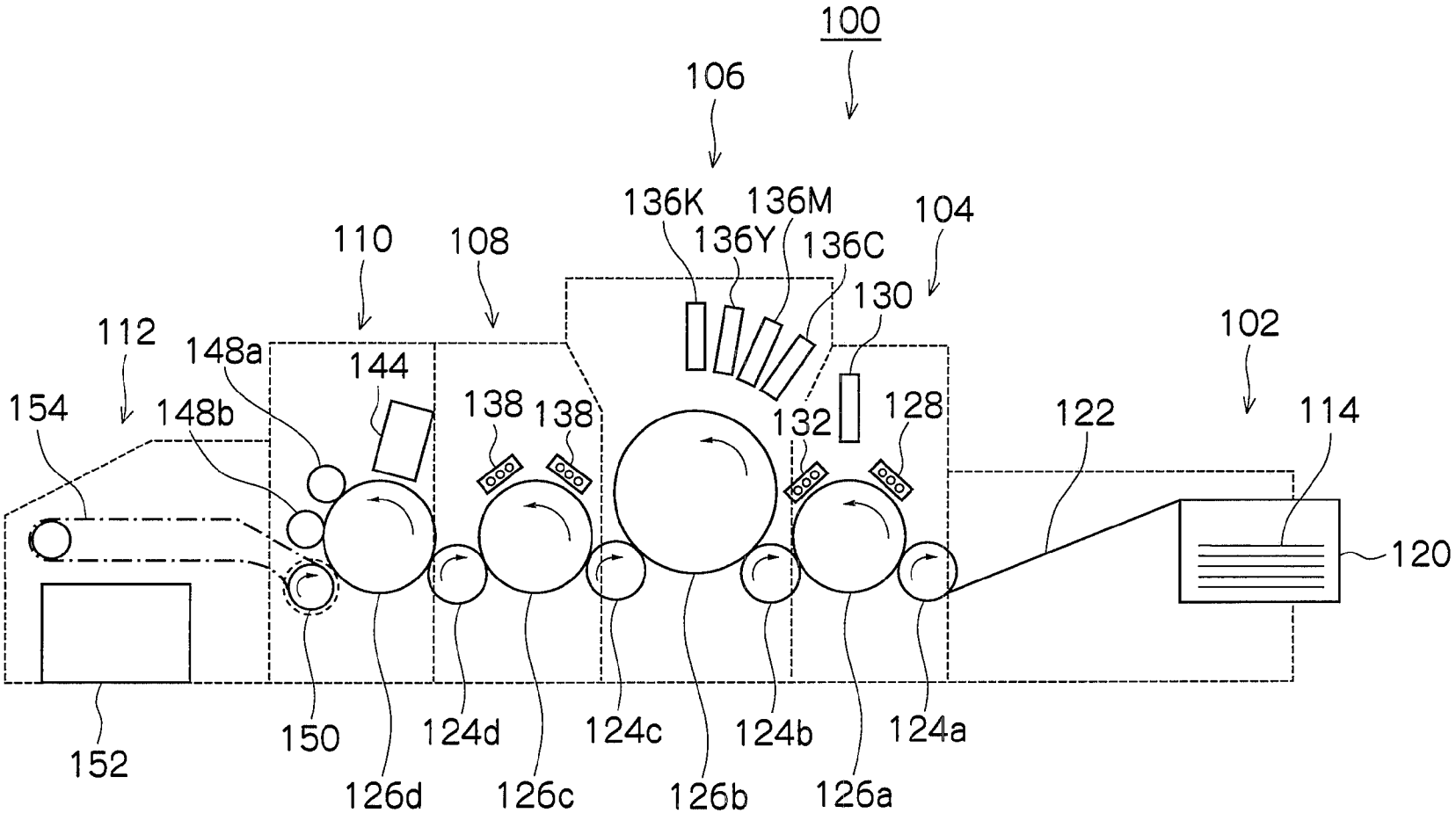
FIG. 5 is a general schematic drawing showing an image forming apparatus according to another embodiment of the present invention.

FIG. 5 is a general schematic drawing showing an image forming apparatus according to another embodiment of the present invention, in which the drum system is employed.

The image forming apparatus (inkjet recording apparatus) 100 shown in FIG. 5 is a recoding apparatus that employs a two-liquid reaction system using ink and treatment liquid (aggregating treatment liquid) to form an image on a recording medium 114. The inkjet recording apparatus 100 includes: a paper supply unit 102, which supplies the recording medium 114; a treatment liquid deposition unit 104, which deposits the treatment liquid on the recording medium 114; an ink deposition unit (print unit) 106, which forms an image by depositing droplets of colored ink onto the recording medium 114; a solvent removing unit 108, which removes the solvent component (liquid component) on the recording medium 114; a fixing unit 110, which fixes the image formed on the recording medium 114; and a paper output unit 112, which conveys and outputs the recording medium 114 on which the image has been formed.

The paper supply unit 102 is provided with a paper supply platform 120, on which the recording media 114 are stacked. A feeder board 122 is connected to the front (the left-hand side in FIG. 5) of the paper supply platform 120, and the recording media 114 stacked on the paper supply platform 120 are supplied one sheet at a time, successively from the uppermost sheet, to the feeder board 122. The recording medium 114 that has been conveyed to the feeder board 122 is transferred through a transfer drum 124*a* to a pressure drum (treatment liquid drum) 126*a* of the treatment liquid deposition unit 104.

Although not shown in the drawings, holding hooks (grippers) and a suction port for holding the leading edge of the recording medium 114 are formed on the surface (circumferential surface) of the pressure drum 126*a*, and the recording medium 114 that has been transferred to the pressure drum 126*a* from the transfer drum 124*a* is conveyed in the direction of rotation (the counter-clockwise direction in FIG. 5) of the pressure drum 126*a* in a state where the leading edge is held by the holding hooks and the medium adheres tightly to the surface of the pressure drum 126*a* (in other words, in a state where the medium is wrapped about the pressure drum 126*a*). A similar composition is also employed for the other pressure drums 126*b* to 126*d*, which are described hereinafter.

The treatment liquid deposition unit 104 is provided with a paper preheating unit 128, a treatment liquid ejection head 130 and a treatment liquid drying unit 132 at positions opposing the surface of the pressure drum 126*a*, in this order from the upstream side in terms of the direction of rotation of the pressure drum 126*a* (the counter-clockwise direction in FIG. 5).

The paper preheating unit 128 is provided with a hot air drying device blowing hot air of which the temperature and flow rate can be controlled within a prescribed range, thereby achieving a composition where the hot air heated by the hot air drying device is blown onto the recording medium 114 when the recording medium 114 that is held on the pressure drum 126*a* passes the position opposing the hot air drying device of the paper preheating unit 128.

The treatment liquid ejection head 130 ejects and deposits droplets of the treatment liquid onto the recording medium 114 that is held on the pressure drum 126*a*. The treatment liquid ejection head 130 adopts the same composition as ink ejection heads 136C, 136M, 136Y and 136K of the ink deposition unit 106, which is described below.

In the present embodiment, the inkjet head is used to deposit the treatment liquid onto the surface of the recording medium 114; however, the present invention is not limited to this, and it is possible to employ a spraying method, an application method, or other methods of various types.

The treatment liquid used in the present embodiment is an acidic liquid that has the action of aggregating the coloring materials contained in the inks that are ejected onto the recording medium 114 respectively from the ink ejection heads 136C, 136M, 136Y and 136K disposed in the ink deposition unit 106, which is arranged at a downstream stage.

The treatment liquid drying unit 132 is provided with a hot air drying device blowing hot air of which the temperature and flow rate can be controlled within a prescribed range, thereby achieving a composition where the hot air heated by the hot air drying device is blown onto the treatment liquid on the recording medium 114 when the recording medium 114 that is held on the pressure drum 126*a* passes the position opposing the hot air drying device of the treatment liquid drying unit 132. In the present embodiment, the treatment liquid is dried by means of the hot air of 80° C.

The temperature and flow rate of the hot air drying device are set to values whereby the treatment liquid having been deposited on the recording medium 114 by the treatment liquid ejection head 130 disposed to the upstream side in terms of the direction of rotation of the pressure drum 126*a* is dried so that the solid or semi-solid aggregating treatment agent layer (the thin film layer of dried treatment liquid) is formed on the surface of the recording medium 114. It is desirable to perform the drying so that the thickness of the aggregating treatment agent layer (treatment liquid layer) after the drying is not greater than 1 μm.

It is desirable that the recording medium 114 is preheated by the paper preheating unit 128, before depositing the treatment liquid on the recording medium 114, as in the present embodiment. In this case, it is possible to restrict the heating energy required to dry the treatment liquid to a low level, and therefore energy savings can be made.

The ink deposition unit 106 is arranged after the treatment liquid deposition unit 104. A transfer drum 124*b* is arranged between the pressure drum (treatment liquid drum) 126*a* of the treatment liquid deposition unit 104 and a pressure drum (print drum) 126*b* of the ink deposition unit 106, so as to make contact with same. Hence, after the treatment liquid is deposited and the treatment liquid layer (desirably, the solid or semi-solid aggregating treatment agent layer) is formed on the recording medium 114 that is held on the pressure drum 126*a* of the treatment liquid deposition unit 104, the recording medium 114 is transferred through the transfer drum 124*b* to the pressure drum 126*b* of the ink deposition unit 106.

The ink deposition unit 106 is provided with ink ejection heads 136C, 136M, 136Y and 136K, which correspond respectively to the four colors of ink, C, M, Y and K, at positions opposing the surface of the pressure drum 126*b*, in this order from the upstream side in terms of the direction of rotation of the pressure drum 126*b* (the counter-clockwise direction in FIG. 5).

The ink ejection heads 136C, 136M, 136Y and 136K employ the inkjet type recording heads (inkjet heads), similarly to the above-described treatment liquid ejection head 130. The ink ejection heads 136C, 136M, 136Y and 136K respectively eject droplets of corresponding colored inks onto the recording medium 114 held on the pressure drum 126*b*.

An ink storing and loading unit (not shown) is configured by ink tanks that store colored inks supplied to the ink ejection heads 136C, 136M, 136Y and 136K. Each ink tank communicates with a corresponding head through a required channel, and supplies the corresponding ink to the head. The ink storing and loading unit also includes a notification device (display device, alarm sound generator) such that when the residual amount of ink is small, the user is notified to this effect. In addition, the ink storing and loading unit includes a mechanism preventing the erroneous loading of colored inks.

The colored inks are supplied to the ink ejection heads 136C, 136M, 136Y and 136K from the tanks of the ink storing and loading unit, and droplets of the colored inks are ejected and deposited to the recording medium 114 by the ink ejection heads 136C, 136M, 136Y and 136K in accordance with the image signal.

Each of the ink ejection heads 136C, 136M, 136Y and 136K is a full-line head having a length corresponding to the maximum width of the image forming region of the recording medium 114 held on the pressure drum 126*b*, and having a plurality of nozzles 161 (not shown in FIG. 5 and shown in FIGS. 6A to 6C) for ejecting the ink, which are arranged on the ink ejection surface of the head through the full width of the image forming region. The ink ejection heads 136C, 136M, 136Y and 136K are arranged so as to extend in a direction that is perpendicular to the direction of rotation of the pressure drum 126*b* (the conveyance direction of the recording medium 114).

According to the composition in which the full line heads having the nozzle rows covering the full width of the image forming region of the recording medium 114 are provided respectively for the colors of ink, it is possible to record a primary image on the image forming region of the recording medium 114 by performing just one operation of moving the recording medium 114 and the ink ejection heads 136C, 136M, 136Y and 136K relatively with respect to each other (in other words, by one sub-scanning action). Therefore, it is possible to achieve a higher printing speed compared to a case that uses a serial (shuttle) type of head moving back and forth reciprocally in the main scanning direction, which is the direction perpendicular to the sub-scanning direction or the conveyance direction of the recording medium 114, and hence it is possible to improve the print productivity.

The inkjet recording apparatus 100 according to the present embodiment is able to record on recording media (recording paper) up to a maximum size of 720 mm×520 mm and hence a drum having a diameter of 810 mm corresponding to the recording medium width of 720 mm is used for the pressure drum (print drum) 126*b*. The drum rotation peripheral speed when depositing the ink droplets is about 500 mm/sec. The ink ejection volume of the ink ejection heads 136C, 136M, 136Y and 136K is 6 ng, and the recording density is 1200 dpi in both the main scanning direction (the breadthways direction of the recording medium 114) and the sub-scanning direction (the conveyance direction of the recording medium 114).

Although the configuration with the four colors of C, M, Y and K is described in the present embodiment, the combinations of the ink colors and the number of colors are not limited to those. Light and/or dark inks, and special color inks can be added as required. For example, a configuration is possible in which ink ejection heads for ejecting light-colored inks, such as light cyan and light magenta, are added. Furthermore, there is no particular restriction on the arrangement sequence of the heads of the respective colors.

The solvent removing unit 108 is arranged after the ink deposition unit 106. A transfer drum 124*c* is arranged between the pressure drum (print drum) 126*b* of the ink deposition unit 106 and a pressure drum (solvent removing drum) 126*c* of the solvent removing unit 108, so as to make contact with same. Hence, after the colored inks are deposited on the recording medium 114 that is held on the pressure drum 126*b* of the ink deposition unit 106, the recording medium 114 is transferred through the transfer drum 124*c* to the pressure drum 126*c* of the solvent removing unit 108.

The solvent removing unit 108 is provided with ink drying units 138 at positions opposing the surface of the pressure drum 126*c*, in this order from the upstream side in terms of the direction of rotation of the pressure drum 126*c* (the counter-clockwise direction in FIG. 5). It is desirable that the solvent removing unit is further provided with a solvent removing roller (not shown) at the downstream side of the ink drying units 138.

Similarly to the image forming apparatus 10 shown in FIG. 1, the ink drying unit 138 is required to have a function which enables control of the degree of drying of the ink layer formed on the recording medium 114, and it is particularly desirable if the degree of drying can be controlled for each of the portions 12*a*. More specifically, the degree of drying is controlled in such a manner that the amount of water remaining after drying in the ink layer formed on the recording medium 114 is not more than 4.0 g/m$^2$. Furthermore, if the amount of water in the ink deposited on the recording medium 12 before the drying is a large amount of not less than 6.0 g/m$^2$, then the degree of drying is controlled in such a manner that the amount of remaining water does not become less than 0.5 g/m$^2$.

More specifically, by blowing a hot air flow heated to a prescribed temperature (for example, 70° C.) onto the recording medium 114 for a prescribed duration by means of the hot air flow drying device of the ink drying unit 138, the solvent component (mainly water) of the ink layer on the recording medium 114 is evaporated off. By this means, the amount of water originating from the ink and still remaining after drying in the ink layer formed on the recording medium 114 is controlled.

The fixing unit 110 is arranged after the solvent removing unit 108. A transfer drum 124*d* is arranged between the pressure drum (solvent removing drum) 126*c* of the solvent removing unit 108 and a pressure drum (fixing drum) 126*d* of the fixing unit 110, so as to make contact with same. Hence, after the solvent component is removed from the recording medium 114 that is held on the pressure drum 126*c* of the solvent removing unit 108, the recording medium 114 is transferred through the transfer drum 124*d* to the pressure drum 126*d* of the fixing unit 110.

The fixing unit 110 is provided with a print determination unit 144, which reads in the print results of the ink deposition unit 106, and heating rollers 148*a* and 148*b* at positions opposing the surface of the pressure drum 126*d*, in this order from the upstream side in terms of the direction of rotation of the pressure drum 126*d* (the counter-clockwise direction in FIG. 5).

The print determination unit 144 includes an image sensor (a line sensor, or the like), which captures an image of the print result of the ink deposition unit 106 (the droplet ejection results of the ink ejection heads 136C, 136M, 136Y and 136K), and functions as a device for checking for nozzle blockages and other ejection defects, on the basis of the droplet ejection image captured through the image sensor.

The heating rollers 148*a* and 148*b* are rollers of which temperature can be controlled in a prescribed range (e.g., 60°

C. to 100° C.), and fix the image formed on the recording medium 114 while nipping the recording medium 114 between the pressure drum 126*d* and each of the heating rollers 148*a* and 148*b* to heat and press the recording medium 114.

In the present embodiment, the heating temperature of the heating rollers 148*a* and 148*b* is set to 75° C., and the surface temperature of the pressure drum 126*d* is set to 60° C. Furthermore, the nip pressure of the heating rollers 148*a* and 148*b* is 1.0 MPa. It is desirable that the heating temperature of the heating rollers 148*a* and 148*b* is set in accordance with the glass transition temperature of the polymer particles contained in the treatment liquid or the ink.

The paper output unit 112 is arranged after the fixing unit 110. The paper output unit 112 is provided with a paper output drum 150, which receives the recording medium 114 on which the image has been fixed, a paper output platform 152, on which the recording media 114 are stacked, and a paper output chain 154 having a plurality of paper output grippers, which is spanned between a sprocket arranged on the paper output drum 150 and a sprocket arranged above the paper output platform 152.

Next, the structure of the ink ejection heads 136C, 136M, 136Y and 136K disposed in the ink deposition unit 106 is described in detail. The ink ejection heads 136C, 136M, 136Y and 136K have a common structure, and in the following description, these ink ejection heads are represented by an ink ejection head (hereinafter, simply called a "head") denoted with reference numeral 160.

Figure 6A:
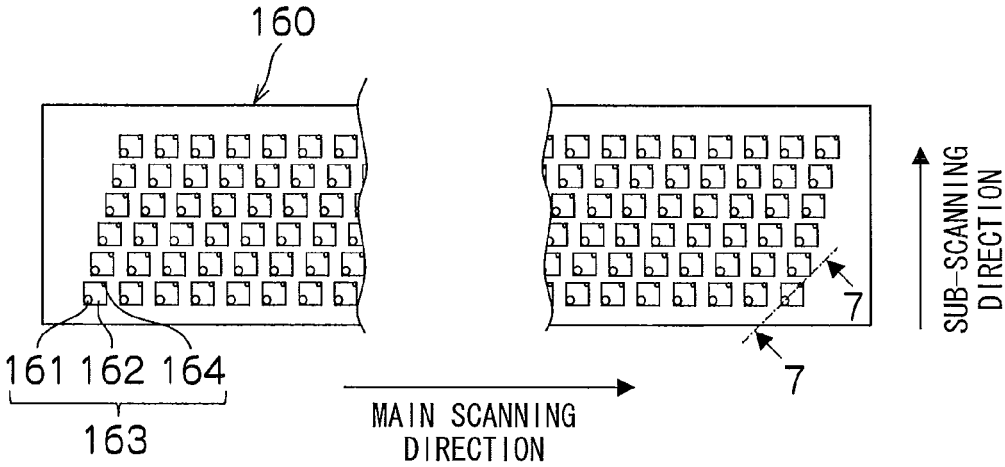
FIGS. 6A to 6C are plan view perspective diagrams showing compositions of inkjet heads.
Figure 6B:
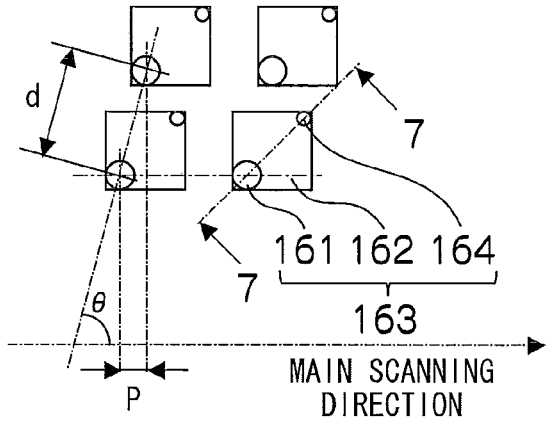
Figure 6C:
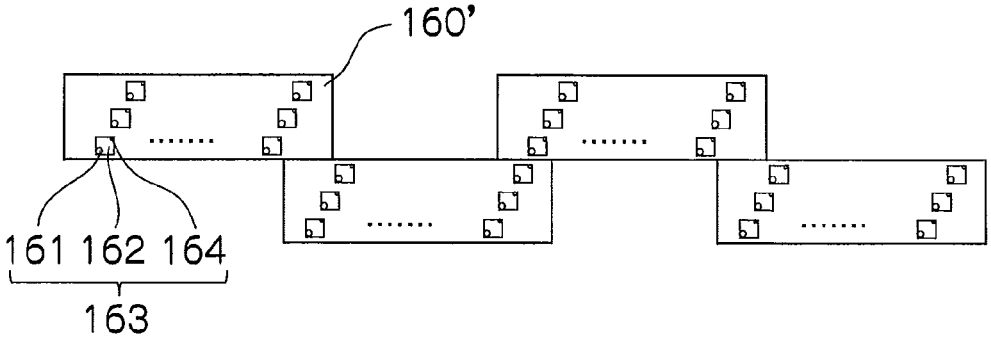
Figure 7:
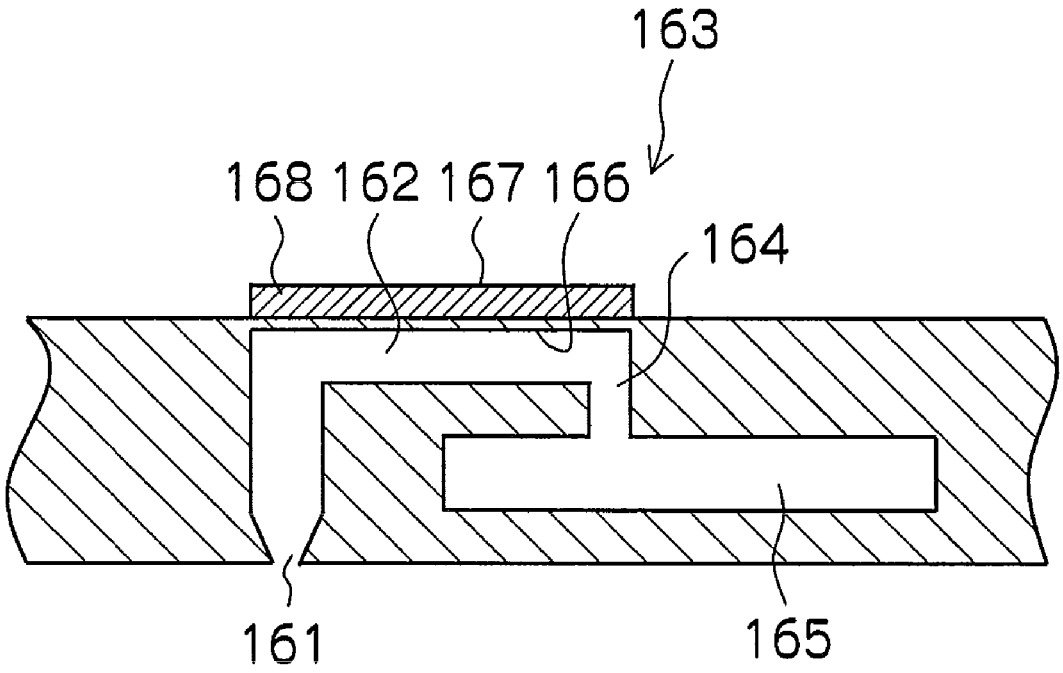
FIG. 7 is a cross-sectional diagram along line 7-7 in FIGS. 6A and 6B.

FIG. 6A is a plan view perspective diagram showing an embodiment of the structure of the head 160; FIG. 6B is an enlarged diagram showing a portion of the head; and FIG. 6C is a plan view perspective diagram showing a further embodiment of the structure of the head 160. FIG. 7 is a cross-sectional diagram along line 7-7 in FIGS. 6A and 6B, and shows the three-dimensional composition of an ink chamber unit.

The nozzle pitch in the head 160 should be minimized in order to maximize the density of the dots formed on the surface of the recording medium 114. As shown in FIGS. 6A and 6B, the head 160 according to the present embodiment has a structure in which a plurality of ink chamber units 163, each having a nozzle 161 forming an ink droplet ejection port, a pressure chamber 162 corresponding to the nozzle 161, and the like, are disposed two-dimensionally in the form of a staggered matrix, and hence the effective nozzle interval (the projected nozzle pitch) as projected in the lengthwise direction of the head (the main-scanning direction perpendicular to the recording medium conveyance direction) is reduced and high nozzle density is achieved.

The mode of forming one or more nozzle rows through a length corresponding to the entire width of the recording area of the recording medium 114 in a direction substantially perpendicular to the conveyance direction of the recording medium 114 is not limited to the embodiment described above. For example, instead of the configuration in FIG. 6A, as shown in FIG. 6C, a line head having the nozzle rows of the length corresponding to the entire width of the recording area of the recording medium 114 can be formed by arranging and combining, in a staggered matrix, short head blocks 160' each having a plurality of nozzles 161 arrayed two-dimensionally. Furthermore, although not shown in the drawings, it is also possible to compose a line head by arranging short heads in one row.

The pressure chamber 162 provided corresponding to each of the nozzles 161 is approximately square-shaped in plan view, and the nozzle 161 and a supply port 164 are arranged respectively at corners on a diagonal of the pressure chamber 162. Each pressure chamber 162 is connected through the supply port 164 to a common flow channel 165. The common flow channel 165 is connected to an ink supply tank (not shown), which is a base tank that supplies ink, and the ink supplied from the ink supply tank is delivered through the common flow channel 165 to the pressure chambers 162.

A piezoelectric element 168 provided with an individual electrode 167 is bonded to a diaphragm 166, which forms the upper face of the pressure chamber 162 and also serves as a common electrode, and the piezoelectric element 168 is deformed when a drive voltage is applied to the individual electrode 167, thereby causing the ink to be ejected from the nozzle 161. When the ink is ejected, new ink is supplied to the pressure chamber 162 from the common flow passage 165 through the supply port 164.

In the present embodiment, the piezoelectric element 168 is used as an ink ejection force generating device, which causes the ink to be ejected from the nozzle 160 in the head 161; however, it is also possible to employ a thermal method in which a heater is provided inside the pressure chamber 162 and the ink is ejected by using the pressure of the film boiling action caused by the heating action of this heater.

As shown in FIG. 6B, the high-density nozzle head according to the present embodiment is achieved by arranging the plurality of ink chamber units 163 having the above-described structure in a lattice fashion based on a fixed arrangement pattern, in a row direction that coincides with the main scanning direction, and a column direction that is inclined at a fixed angle of θ with respect to the main scanning direction, rather than being perpendicular to the main scanning direction.

More specifically, by adopting the structure in which the plurality of ink chamber units 163 are arranged at the uniform pitch d in line with the direction forming the angle of θ with respect to the main scanning direction, the pitch P of the nozzles projected so as to align in the main scanning direction is $d \times \cos\theta$, and hence the nozzles 161 can be regarded to be equivalent to those arranged linearly at the fixed pitch P along the main scanning direction. Such configuration results in the nozzle structure in which the nozzle row projected in the main scanning direction has a high nozzle density of up to 2,400 nozzles per inch.

When implementing the present invention, the arrangement structure of the nozzles is not limited to the embodiment shown in the drawings, and it is also possible to apply various other types of nozzle arrangements, such as an arrangement structure having one nozzle row in the sub-scanning direction.

Furthermore, the scope of application of the present invention is not limited to a printing system based on the line type of head, and it is also possible to adopt a serial system where a short head that is shorter than the breadthways dimension of the recording medium 114 is moved in the breadthways direction (main scanning direction) of the recording medium 114, thereby performing printing in the breadthways direction, and when one printing action in the breadthways direction has been completed, the recording medium 114 is moved through a prescribed amount in the sub-scanning direction perpendicular to the breadthways direction, printing in the breadthways direction of the recording medium 114 is carried out in the next printing region, and by repeating this sequence, printing is performed over the whole surface of the printing region of the recording medium 114.

Figure 8:
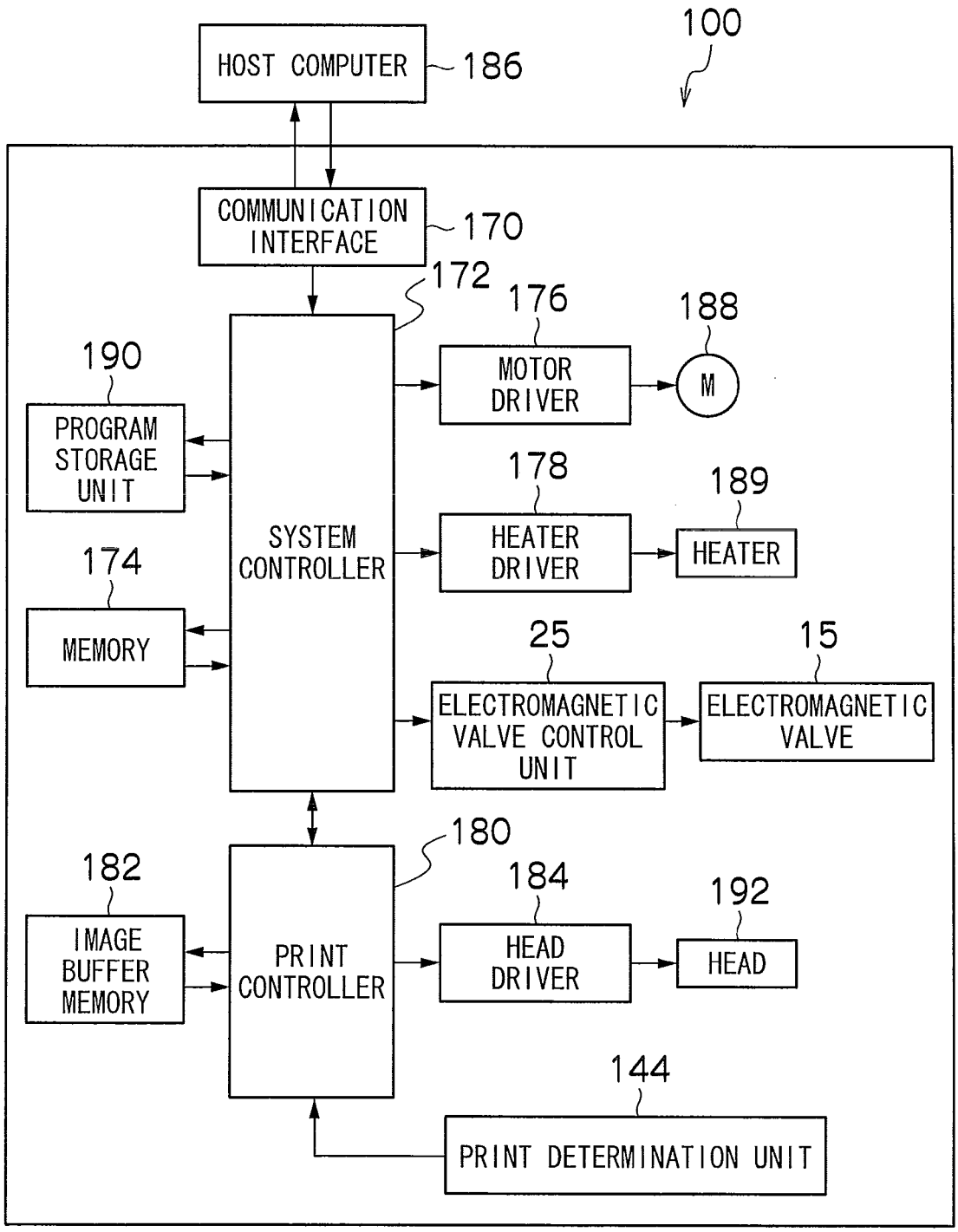
FIG. 8 is a principal block diagram showing a system configuration of the image forming apparatus shown in FIG. 5.

FIG. 8 is a principal block diagram showing the system configuration of the image forming apparatus 100. The image forming apparatus 100 includes the electromagnetic valve control unit 25, a communication interface 170, a system controller 172, a memory 174, a motor driver 176, a heater driver 178, a print controller 180, an image buffer memory 182, a head driver 184, a program storage unit 190 and the like.

The communication interface 170 is an interface unit for receiving image data sent from a host computer 186. A serial interface such as USB (Universal Serial Bus), IEEE1394, Ethernet, wireless network, or a parallel interface such as a Centronics interface may be used as the communication interface 170. A buffer memory (not shown) may be mounted in this portion in order to increase the communication speed. The image data sent from the host computer 186 is received by the image forming apparatus 100 through the communication interface 170, and is temporarily stored in the memory 174.

The memory 174 is a storage device for temporarily storing image data inputted through the communication interface 170, and data is written and read to and from the memory 174 through the system controller 172. The memory 174 is not limited to a memory composed of semiconductor elements, and a hard disk drive or another magnetic medium may be used.

The system controller 172 is constituted of a central processing unit (CPU) and peripheral circuits thereof, and the like, and it functions as a control device for controlling the whole of the image forming apparatus 100 in accordance with a prescribed program, as well as a calculation device for performing various calculations. More specifically, the system controller 172 controls the various sections, such as the electromagnetic valve control unit 25, communication interface 170, memory 174, motor driver 176, heater driver 178, and the like, as well as controlling communications with the host computer 186 and writing and reading to and from the memory 174, and it also generates control signals for controlling the motor 188 and heater 189 of the conveyance system.

The program executed by the CPU of the system controller 172 and the various types of data which are required for control procedures are stored in the memory 174. The memory 174 may be a non-rewriteable storage device, or it may be a rewriteable storage device, such as an EEPROM. The memory 174 is used as a temporary storage region for the image data, and it is also used as a program development region and a calculation work region for the CPU.

Various control programs are stored in the program storage unit 190, and a control program is read out and executed in accordance with commands from the system controller 172. The program storage unit 190 may use a semiconductor memory, such as a ROM, EEPROM, or a magnetic disk, or the like. An external interface may be provided, and a memory card or PC card may also be used. Naturally, a plurality of these recording media may also be provided. The program storage unit 190 may also be combined with a storage device for storing operational parameters, and the like (not shown).

The motor driver 176 is a driver that drives the motor 188 in accordance with instructions from the system controller 172. In FIG. 8, the plurality of motors (actuators) disposed in the respective sections of the image forming apparatus 100 are represented by the reference numeral 188. For example, the motor 188 shown in FIG. 8 includes the motors that drive the pressure drums 126*a* to 126*d*, the transfer drums 124*a* to 124*d* and the paper output drum 150, shown in FIG. 5.

The heater driver 178 is a driver that drives the heater 189 in accordance with instructions from the system controller 172. In FIG. 8, the plurality of heaters disposed in the image forming apparatus 100 are represented by the reference numeral 189. For example, the heater 189 shown in FIG. 8 includes the heaters of the paper preheating unit 128, the treatment liquid drying unit 132, the hot air drying devices provided in the ink drying units 138, and the like, shown in FIG. 5.

The electromagnetic valve control unit 25 controls the degree of drying for each of the portions 12*a* virtually divided on the image region of the recording medium 12, for example, by switching the electromagnetic valves 15 shown in FIGS. 3A and 3B on and off in accordance with instructions from the system controller 172.

The print controller 180 is a control unit that has signal processing functions for carrying out processing, collection, and other treatments in order to generate a print control signal on the basis of the image data in the memory 174 in accordance with the control of the system controller 172. The print controller 180 supplies the print data (dot data) thus generated to the head driver 184. Prescribed signal processing is carried out in the print controller 180, and the ejection volume and the ejection timing of the ink droplets in the head 192 are controlled through the head driver 184 on the basis of the image data. By this means, prescribed dot size and dot positions can be achieved. In FIG. 8, the plurality of heads (inkjet heads) disposed in the inkjet recording apparatus 100 are represented by the reference numeral 192. For example, the head 192 shown in FIG. 8 includes the ink ejection heads 136C, 136M, 136Y and 136K shown in FIG. 5.

The print controller 180 is provided with the image buffer memory 182, and image data, parameters, and other data are temporarily stored in the image buffer memory 182 when image data is processed in the print controller 180. Also possible is an aspect in which the print controller 180 and the system controller 172 are integrated to form a single processor.

The head driver 184 generates drive signals to be applied to the piezoelectric elements 168 of the head 192, on the basis of image data supplied from the print controller 180, and also has drive circuits which drive the piezoelectric elements 168 by applying the drive signals to the piezoelectric elements 168. A feedback control system for maintaining constant drive conditions in the head 192 may be included in the head driver 184 shown in FIG. 8.

The print determination unit 144 is a block that includes the line sensor as described above with reference to FIG. 5, reads the image printed on the recording medium 114, determines the print conditions (presence of the ejection, variation in the dot formation, and the like) by performing desired signal processing, or the like, and provides the determination results of the print conditions to the print controller 180. According to requirements, the print controller 180 makes various corrections with respect to the head 192 on the basis of information obtained from the print determination unit 144.

EXAMPLES

There follows a description of examples of the present invention.

The compositions of the treatment liquid (aggregating treatment liquid) and the ink, the types of the recording media, experimental conditions, and criteria of the results of the experiments of the example of the present invention were as described below. As the image forming apparatus, the apparatus having the composition shown in FIG. 1 was used.

Preparation of the Treatment Liquid

A treatment liquid was prepared by mixing together the following materials:

| | |
|---|---|
| Citric acid (made by Wako Pure Chemical Industries): | 16.7 wt % |
| Diethylene glycol monomethyl ether (made by Wako Pure Chemical Industries): | 20.0 wt % |
| Zonyl FSN-100 (made by Dupont): | 1.0 wt % |
| Deionized water: | 62.3 wt % |

The physical properties of the treatment liquid thus prepared were measured as: the viscosity was 4.9 mPa·s, the surface tension was 24.3 mN/m and the pH was 1.5.

Preparation of the Ink

<Preparation of Polymer Dispersant P-1>

88 g of methylethyl ketone was introduced into a 1000 ml three-mouthed flask fitted with an agitator and cooling tube, and was heated to 72° C. in a nitrogen atmosphere, whereupon a solution formed by dissolving 0.85 g of dimethyl 2,2'-azobis isobutylate, 60 g of benzyl methacrylate, 10 g of methacrylic acid and 30 g of methyl methacrylate in 50 g of methylethyl ketone was added to the flask by titration over three hours. When titration had been completed and after reacting for a further hour, a solution of 0.42 g of dimethyl 2,2'-asobis isobutylate dissolved in 2 g of methylethyl ketone was added, the temperature was raised to 78° C. and the mixture was heated for 4 hours. The reaction solution thus obtained was suspended twice in an excess amount of hexane, and the precipitated resin was dried, yielding 96 g of a polymer dispersant P-1.

The composition of the resin thus obtained was confirmed using a 1H-NMR, and the weight-average molecular weight (Mw) determined by GPC was 44600. Moreover, the acid number of the polymer was 65.2 mg KOH/g as determined by the method described in Japanese Industrial Standards (JIS) specifications (JIS K 0070-1992).

<Preparation of Cyan Dispersion Liquid>

10 parts of Pigment Blue 15:3 (phthalocyanine blue A220 made by Dainichi Seika Color & Chemicals), 5 parts of the polymer dispersant P-1 obtained as described above, 42 parts of methylethyl ketone, 5.5 parts of an aqueous 1 mol/L NaOH solution, and 87.2 parts of deionized water were mixed together, and dispersed for 2 to 6 hours using 0.1 mm diameter zirconia beads in a beads mill.

The methylethyl ketone was removed from the obtained dispersion at 55° C. under reduced pressure, and moreover a portion of the water was removed, thus obtaining a cyan dispersion liquid having a pigment concentration of 10.2 wt %.

The cyan dispersion liquid forming a coloring material was prepared as described above.

Inks (inkjet recording liquids) 1 and 2 were prepared by mixing together components to achieve the ink compositions described below, using the coloring material (cyan dispersion liquid) obtained as described above. The difference in the inks 1 and 2 is the SP value (solubility parameter) of the high-boiling-point solvent; and more specifically, the SP value of trioxypropylene glyceryl ether in the ink 1 is 26.38, and the SP value of glycerin in the ink 2 is 40.97.

<Composition of Ink 1>

| | |
|---|---|
| Cyan pigment (Pigment Blue 15:3) | 4 wt % |
| Polymer dispersant (the above-described P-1) | 2 wt % |
| Trioxypropylene glyceryl ether (Sannix GP250 (made by Sanyo Chemical Industries)) | 15 wt % |
| Olefin E1010 (a surfactant, made by Nisshin Chemical Industry) | 1 wt % |
| Joncryl 537 (styrene-acrylic resin emulsion, made by Johnson Polymers) | 12 wt % |
| Deionized water | 66 wt % |

-continued

<Composition of Ink 2>

| | |
|---|---|
| Cyan pigment (Pigment Blue 15:3) | 4 wt % |
| Polymer dispersant (the above-described P-1) | 2 wt % |
| Glycerin (made by Wako Pure Chemical Industries): | 15 wt % |
| Olefin E1010 (a surfactant, made by Nisshin Chemical Industry) | 1 wt % |
| Joncryl 537 (styrene-acrylic resin emulsion, made by Johnson Polymers) | 12 wt % |
| Deionized water | 66 wt % |

Type of Recording Medium (Paper)

Three types of recording media were used: Tokubishi Art, OK Top Coat, and New Age, which have been described in the preferred embodiments. In the following description, the recording media are referred to simply as the "paper 12".

Method of Evaluating Test Results

A total of five items were evaluated in the printing onto the paper 12: "offset", "fixing properties", "curl", "bleeding" and "floating of the dots", and the evaluation levels were as indicated below.

<Offset>

When a fixing step was carried out using the ink and the treatment liquid described above, a "good" verdict was given in cases where coloring material did not adhere to the heating roller 33 and there was no deterioration in the image surface, a "fair" verdict was given in cases where coloring material adhered to the heating roller 33 but there was no deterioration in the image surface, and a "poor" verdict was given in cases where coloring material adhered to the heating roller 33 and also deterioration was observed in the image surface. The temperature of the heating roller was set to two levels: 50° C. and 75° C.

<Fixing Properties>

When the print region of paper 12 printed with a solid pattern was rubbed back and forth ten times with a sheet of paper 12 on which no printing had been performed, a "good" verdict was given in cases where coloring material did not adhere to the rubbing sheet of paper 12 and no image deterioration was observed in the rubbed sheet of paper 12, a "fair" verdict was given in cases where coloring material adhered to the rubbing sheet of paper 12 but no image deterioration was observed in the rubbed sheet of paper 12, a "passing" verdict was given in cases where coloring material adhered to the rubbing sheet of paper 12 and also image deterioration was observed in the rubbed sheet of paper 12, and a "poor" verdict was given in cases where the color of the rubbing sheet of paper 12 was more dense than the rubbed sheet of paper 12.

<Curl>

A sheet of paper 12 on which a solid pattern had been printed was cut to A5 size, the sheet of paper 12 was placed on a flat bench, and the heights of rising up of the four corner points were measured. A "poor" verdict was given if the arithmetic average of the heights of rising up of the four corner points was 2.0 cm or greater, a "fair" verdict was given if this average was less than 2.0 cm and not less than 1.0 cm, and a "good" verdict was given if the average was less than 1.0 cm. If the sheet of paper 12 curled in such a manner that the central region of the printed surface rose up, then the sheet of paper 12 was turned over in such a manner that the four corner points were curled upwards, and measurement was then carried out.

<Bleeding (Aggregating Characteristics)>

When ink was printed in a single pass in lines of 1200 dpi, a "poor" verdict was given if non-uniformity in line width, discontinuity of the lines or liquid pooling was observed, and a "good" verdict was given in all other cases.

<Floating of Dots>

Ink was printed in a single pass at a lattice pattern having 150 dpi separation, and a "poor" verdict was given in cases where the average amount of deviation of the pitch between dots was not less than 5% (in other words, not less than 8.5 μm), a "fair" verdict was given in cases where this average was less than 5% and not less than 3% (in other words, less than 8.5 μm and not less than 5.1 μm), and a "good" verdict was given in cases where the average was less than 3% (in other words, less than 5.1 μm).

Test Conditions

An ink layer was formed by printing a solid pattern onto a sheet of paper 12 onto which the treatment liquid had been deposited, and the relationship between the amount of water originating from the ink and still remaining in the ink layer after drying and the evaluation items described above was investigated. In conjunction with this, the effects of not depositing the treatment liquid, the effects of not drying the treatment liquid and the effects due to the type of recording medium were also investigated.

Here, solid printing is defined as a printing at a droplet deposition density of 1200 dpi×1200 dpi×6 ng. Hence, the deposition volume of the water contained in the ink in the case of solid printing (only the amount of water contained in the ink) can be calculated as 8.8 g/m$^2$ by means of the following calculation (1):

$$6\times10^{-9}(g)\times0.66\times1200\times1200/(0.02542(m^2))=8.8g/m^2. \quad (1)$$

Here, 0.66 is the water content percentage of the ink composition described above.

<Method of Determining Amount of Remaining Water>

The amount of water remaining after drying was found by cutting the sheet of paper 12 after drying of the ink into a rectangular shape of 1.0 cm×5.0 cm, and then determining the absolute volume of the water using a Mitsubishi Chemical CA-200 moisture meter. The moisture content value (the water contained originally by the paper plus the water in the treatment liquid) was determined separately by a similar method in respect of paper onto is which only the treatment liquid had been deposited, and the "amount of water remaining after drying" was defined as the difference found by subtracting the amount of water originating from the treatment liquid and the paper, from the amount of water contained in the ink.

Test A

FIG. 9 shows the test results of Test A for cases where the ink 1 was used. Three types of paper, Tokubishi Art, OK Top Coat and New Age, were used, and the treatment liquid conditions (deposition or no deposition and drying or no drying) and the ink drying conditions (drying or no drying and different degrees of drying) were altered. Furthermore, each of Levels 1 to 5 of the ink drying in FIG. 9 indicates the degree of drying, in other words, the duration of the blowing of the heated air flow (i.e., the duration of the opening of the electromagnetic valve), and the degree of drying successively becomes greater from Level 1 to Level 5.

<Evaluation Results for Offset>

From the test results in FIG. 9, it is seen that if the treatment liquid is deposited onto the paper 12 to make the ink aggregate to form the ink layer, then the occurrence of offset is governed by the amount of water remaining after drying of the ink. More specifically, if the amount of remaining water is 4 g/m$^2$ or lower, then the offset has the evaluation of "good".

As can be seen from the test 1-6, test 1-8, test 1-17, test 1-19 and test 1-30, if the treatment liquid is not deposited and the ink alone forms the ink layer, then offset occurs even if the amount of remaining water is not more than 4.0 g/m$^2$. This is because there is no aggregating action and therefore the adhesion between pigment particles is weak and there is separation of the pigment particles. For this reason, it is important that the amount of water remaining after drying of the ink layer in which the ink has been made aggregated by the deposited treatment liquid on the paper should be not more than 4 g/m$^2$.

In the test results where the amount of remaining water exceeded 4 g/m$^2$ and offset occurred, there was offset not only when the temperature of the heating roller was 75° C., but also at the lower temperature of 50° C. The results would suggest that the offset in this case is offset due to separation of the liquid because of excess water on the surface of the paper, rather than "hot offset", which is caused by the latex component of the ink melting and a portion thereof separating and adhering to the heating roller.

It can also be seen that in each of the three types of paper, if the treatment liquid is deposited, then offset does not occur provided that the amount of remaining water is not more than 4 g/m$^2$.

<Evaluation Results for Fixing Properties>

The fixing properties were good in all cases where the offset had the evaluation level of "good" or "fair".

<Evaluation Results for Curl>

Similarly to offset, curl is also governed by the amount of water remaining after drying of the ink, and it is seen that if the amount of water remaining after drying of the ink is great and exceeds 4.7 g/m$^2$, then curl occurs. Furthermore, it can be seen that if excessive drying is carried out so that the amount of remaining water becomes less than 0.5 g/m$^2$, then the curl becomes worse. This factor was investigated in detail in the items in Test C described below.

<Evaluation Results for Bleeding and Floating of Dots>

When the bleeding was examined, it was found to be satisfactory in all the cases where the treatment liquid was deposited. Furthermore, the floating of the dots was satisfactory in all the cases where the treatment liquid was not used or where the treatment liquid was dried.

Test B

FIG. 10 shows the test results of Test B for cases where the ink 2 was used instead of the ink 1 used in Test A. More specifically, the high-boiling-point solvent of the ink 2 was changed from trioxypropylene glyceryl ether used in the ink 1 to glycerin so as to raise the SP value.

In Test B, the relationship between the test conditions in the respective tests and the evaluation results for the respective evaluation items showed the same overall tendencies as Test A; however, in respect of curl, the ink 2 produced worse evaluation results than the ink 1.

Hence, it can be seen that the high-boiling-point solvent contained in the ink also has a great effect. In the present tests, trioxypropylene glyceryl ether was used in the ink 1, and glycerin, which is generically employed in the inkjet method, was used in the ink 2. It can be seen that if sufficient drying is applied, then the former has a greater effect in suppressing curl. This is because of the difference in the SP value between the respective solvents. The SP value of glycerin is 40.97 and higher than the SP value of 26.38 of trioxypropylene glyceryl ether. The solubility parameter value (SP value) of the water-soluble high-boiling-point solvent described in the present specification is a value expressed as the square root of the molecular aggregation energy. This value can be calculated by the method described in R. F. Fedors in Polymer Engineering Science, 14, p. 147 (1974), and is the value used in the present invention.

Although only two types of SP value, 26.38 and 40.97, are described in the present experiments, when the relationship between the SP value and the curl was investigated, it was found that if the SP value was greater than 27.5, curl was liable to occur. For this reason, it is desirable to use a high-boiling-point solvent having an SP value of 27.5 or lower in the ink.

Test C

Test A in FIG. 9 and Test B in FIG. 10 were the tests where the ink 1 was printed in the solid print pattern (ink droplet deposition rate of 100%) onto paper (Tokubishi Art). Test C shown in FIG. 11 investigated the effects on offset and curl when the droplet deposition rate of the ink 1 was varied.

In the items in FIG. 11, an ink droplet deposition rate of 100% means the solid print pattern, and as indicated in the above-described calculation (1), the amount of water in the ink deposited on the paper 12 before drying is 8.8 g/m$^2$. An ink droplet deposition rate of 75% corresponds to 75% of the solid print pattern (the amount of water in the ink deposited on the paper 12 before drying is 6.6 g/m$^2$). An ink droplet deposition rate of 68% corresponds to 68% of the solid print pattern (the amount of water in the ink deposited on the paper 12 before drying is 6.0 g/m$^2$). An ink droplet deposition rate of 50% corresponds to 50% of the solid printing pattern (the amount of water in the ink deposited on the paper 12 before drying is 4.4 g/m$^2$).

As the results shown in FIG. 11 reveal, in the cases where the ink droplet deposition rate was a high rate of 100% or 75%, and the amount of water in the ink deposited on the paper 12 was large, then if excessive drying was carried out in such a manner that the amount of remaining water became less than 0.5 g/m$^2$, curl occurred and the evaluation level was "fair". On the other hand, in the cases where the ink droplet deposition rate was 68% or 50% and the amount of water in the ink deposited on the paper 12 was low, curl did not occur and the evaluation level was "good" even if drying was carried out so that the amount of remaining water became less than 0.5 g/m$^2$.

Normally, curling of the paper 12 occurs in states where there is a large amount of remaining water, as indicated in the tests A and B; however, through the present tests, the inventor discerned that "the degree of curl becomes greater if excessive drying is carried out with respect to the ink layer having a high ink deposition rate". It is thought as a reason to ultimately cause the curl to become greater that: application of a high degree of drying energy promotes the permeation of the high-boiling-point solvent in the ink into the cellulose of the paper 12, and also dries a portion of the water having been held inside the cellulose of the paper 12 and causes the high-boiling-point solvent in the ink to permeate into the cellulose of the paper 12.

Consequently, Test C reveals that in order to prevent curl of the paper 12, it is important to control the degree of drying in such a manner that the amount of remaining water does not become less than 0.5 g/m$^2$ if the amount of water of the ink deposited on the paper 12 before drying is a large amount of 6.0 g/m$^2$ or greater.

With regard to the evaluations of offset, it can be seen that the ink droplet deposition rate has no influence, but the amount of remaining water does have an effect.

Tests D and E

Tests D and E shown in FIGS. 12 and 13 involved changing the ink droplet deposition rate similarly to Test C, and OK Top Coat was used as the paper in Test D and New Age was used as the paper in Test E.

In Tests D and E, similarly to Test C, the evaluation for curl was "fair" at the ink droplet deposition rate of 100% or 75%, and the evaluation for curl was "good" at the ink droplet deposition rate of 68% or 50%. Therefore, it can be seen that curl due to excessive drying occurs irrespectively of the type of paper.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image forming method of forming an image on coated paper for printing by using aqueous ink and treatment liquid, the aqueous ink containing coloring material, the treatment liquid containing a component which reacts with the coloring material, the method comprising:

depositing the treatment liquid onto the coated paper;

ejecting and depositing droplets of the aqueous ink, in accordance with image information, onto the coated paper on which the treatment liquid has been deposited;

drying an ink layer which has been formed on the coated paper by reaction between the deposited treatment liquid and the deposited aqueous ink, such that an amount of water originating from the aqueous ink and still remaining on the coated paper after the ink layer drying is not more than 4.0 g/m$^2$ and, when an amount of water in the aqueous ink deposited on the coated paper before drying of the ink layer is not less than 6.0 g/m$^2$, the amount of water originating from the aqueous ink and still remaining on the coated paper after the ink layer drying is not less than 0.5 g/m$^2$, the amount of water remaining on the coated paper after the ink layer drying being sufficient to prevent both offset of coloring material of the ink and curling of the coated paper; and fixing the dried ink layer on the coated paper by applying heat and pressure to the ink layer.

2. The image forming method as defined in claim 1, further comprising, before the ink deposition, drying a treatment liquid layer which has been formed on the by the depositing of the treatment liquid.

3. The image forming method as defined in claim 2, wherein the treatment liquid layer is dried such that a thickness of the treatment liquid layer after the treatment liquid drying step is not more than 1 μm.

4. The image forming method as defined in claim 1, wherein a solvent having a solubility parameter of not more than 27.5 is used as a high-boiling-point water-soluble solvent of the aqueous ink.

5. The image forming method as defined in claim 1, wherein the drying of the ink includes:

virtually dividing an image region of the coated paper into a plurality of portions arranged in a lattice;

calculating a deposition volume of the aqueous ink to be deposited onto each of the portions in accordance with dot data derived from the image information for depositing the droplets of the aqueous ink; and controlling a degree of drying of each of the portions in accordance with the calculated deposition volume.

6. An image forming apparatus which forms an image on a coated paper for printing by using aqueous ink and treatment liquid, the aqueous ink containing coloring material, the treatment liquid containing a component which reacts with the coloring material, the apparatus comprising:

a treatment liquid deposition unit configured to deposit the treatment liquid onto the coated paper;

a treatment liquid drying unit configured to dry the deposited treatment liquid;

an ink deposition unit configured to eject and deposit droplets of the aqueous ink in accordance with image information, onto the coated paper on which the treatment liquid has been deposited and dried;

an ink drying unit configured to dry an ink layer on the coated paper, the ink layer having been formed by reaction between the deposited treatment liquid and the deposited aqueous ink;

a fixing unit configured to fix the dried ink layer on the coated paper by applying heat and pressure to the dried ink layer; and a drying control device configured to control the ink drying unit so as to control a degree of drying of the ink layer in accordance with dot data derived from the image information, wherein, the drying control device controls the ink drying unit so as to control the degree of ink drying in such a manner that an amount of water originating from the aqueous ink and still remaining on the coated paper after the ink drying becomes not more than 4.0 $g/m^2$, and when an amount of water in the aqueous ink deposited on the coated paper before the ink drying is not less than 6.0 $g/m^2$, then the drying control device controls the ink drying unit so as to control the degree of ink drying in such a manner that the amount of water originating from the aqueous ink and still remaining on the coated paper after the drying does not become less than 0.5 $g/m^2$.

7. The image forming apparatus as defined in claim 6, wherein:

the ink drying unit includes an air nozzle configured to perform blowing of a heated air onto the coated paper; and the drying control device controls the degree of drying by controlling at least one of a blowing volume and a blowing duration of the blowing of the heated air from the air nozzle onto the coated paper.

8. An image forming apparatus which forms an image on a coated paper for printing by using aqueous ink and treatment liquid, the aqueous ink containing coloring material, the treatment liquid containing a component which reacts with the coloring material, the apparatus comprising:

a treatment liquid deposition unit which deposits the treatment liquid onto the coated paper;

a treatment liquid drying unit which dries the deposited treatment liquid;

an ink deposition unit which ejects and deposits droplets of the aqueous ink in accordance with image information, onto the coated paper on which the treatment liquid has been deposited and dried;

an ink drying unit which dries an ink layer on the coated paper, the ink layer having been formed by reaction between the deposited treatment liquid and the deposited aqueous ink;

a fixing unit which fixes the dried ink layer on the coated paper by applying heat and pressure to the dried ink layer;

a system control device which virtually divides an image region of the coated paper into a plurality of portions arranged in a lattice, and determines a deposition volume of the aqueous ink to be deposited onto each of the portions in accordance with dot data derived from the image information; and a drying control device which controls the ink drying unit so as to control a degree of drying of each of the portions in accordance with the deposition volume determined by the system control device, wherein the drying control device controls the ink drying unit so as to control the degree of drying of each of the portions in such a manner that an amount of water originating from the aqueous ink and still remaining on each of the portions after the drying becomes not more than 4.0 g/m2, and wherein when an amount of water in the aqueous ink deposited on each of the portions before the drying is not less than 6.0 g/m2, then the drying control device controls the ink drying unit so as to control the degree of drying of each of the portions in such a manner that the amount of water originating from the aqueous ink and still remaining on each of the portions after the drying does not become less than 0.5 g/m2.

9. The image forming apparatus as defined in claim 8, wherein:

the ink drying unit includes a plurality of air nozzles which are disposed equidistantly in a direction perpendicular to the coated paper and blow a heated air onto a surface of the coated paper; and the drying control device controls the degree of drying of each of the portions by controlling at least one of a blowing volume and a blowing duration of the blowing of the heated air from corresponding one of the air nozzles onto each of the portions in accordance with the deposition volume determined by the system control device.

* * * * *